US011603302B2

(12) United States Patent
Araki et al.

(10) Patent No.: US 11,603,302 B2
(45) Date of Patent: Mar. 14, 2023

(54) WORK GONDOLA APPARATUS AND WORK VEHICLE PROVIDED WITH SAME

(71) Applicant: NIHON BISOH CO., LTD., Tokyo (JP)

(72) Inventors: Chihiro Araki, Tokyo (JP); Toshikazu Kadowaki, Tokyo (JP); Naoki Makishima, Tokyo (JP); Akira Orita, Tokyo (JP)

(73) Assignee: NIHON BISOH CO., LTD., Tokyo (JP)

( * ) Notice: Subject to any disclaimer, the term of this patent is extended or adjusted under 35 U.S.C. 154(b) by 550 days.

(21) Appl. No.: 16/693,935

(22) Filed: Nov. 25, 2019

(65) Prior Publication Data

US 2020/0087128 A1 Mar. 19, 2020

Related U.S. Application Data

(63) Continuation-in-part of application No. PCT/JP2018/026296, filed on Jul. 12, 2018.

(30) Foreign Application Priority Data

Jul. 12, 2017 (JP) ..... JP2017-136504

(51) Int. Cl.
*B66F 11/04* (2006.01)
*B66F 13/00* (2006.01)
(Continued)

(52) U.S. Cl.
CPC ..... *B66F 11/046* (2013.01); *B66F 13/00* (2013.01); *B66F 17/006* (2013.01); *E04G 3/30* (2013.01)

(58) Field of Classification Search
CPC ..... B66F 11/046; B66F 11/00; B66F 13/00; B66F 17/00; B66F 17/006; E04G 3/30; E04G 3/28; E04G 3/325; E04G 2003/286
See application file for complete search history.

(56) References Cited

U.S. PATENT DOCUMENTS 1,187,060 A * 6/1916 Golden ..... E04G 3/32 182/147
1,363,749 A * 12/1920 Peterson ..... E04G 3/32 182/144
(Continued)

FOREIGN PATENT DOCUMENTS

GB 2384481 7/2003
JP 58207276 12/1983
(Continued)

OTHER PUBLICATIONS

PCT International Search Report dated Oct. 2, 2018 for corresponding PCT International Application No. PCT/JP2018/026296, including English translation (4 pages).
(Continued)

*Primary Examiner* — Daniel P Cahn
*Assistant Examiner* — Shiref M Mekhaeil
(74) *Attorney, Agent, or Firm* — Myers Bigel, P.A.

(57) ABSTRACT

A work gondola apparatus is provided with: a work cage into which a worker boards; equipment mounting parts disposed on both outer sides of the work cage; battery-driven elevating/lowering mechanisms which are mounted to the respective equipment mounting parts and which elevate/lower the work cage to a working location by means of cables that are being suspended; and batteries for driving the respective elevating/lowering mechanisms.

10 Claims, 12 Drawing Sheets

(51) Int. Cl.
*B66F 17/00* (2006.01)
*E04G 3/30* (2006.01)

(56) References Cited

U.S. PATENT DOCUMENTS 1,725,183 A * 8/1929 Fischer ..... E04G 3/32 182/147
3,220,509 A * 11/1965 Fisher ..... E04G 3/243 182/47
3,262,517 A * 7/1966 Malec ..... E01D 19/106 182/127
3,357,517 A * 12/1967 Wagner ..... B66F 11/044 182/2.6
3,608,669 A * 9/1971 Lindsay, Jr. ..... E01D 19/106 182/148
3,661,226 A * 5/1972 Fisher ..... E04G 3/30 182/142
4,074,790 A * 2/1978 Colbachini ..... E01D 19/106 182/2.6
4,154,318 A * 5/1979 Malleone ..... E01D 19/106 182/12
4,456,093 A * 6/1984 Finley ..... B66F 11/046 182/2.11
4,461,369 A * 7/1984 Amador ..... B66F 11/044 212/347
4,556,124 A * 12/1985 Lotto ..... E01D 19/106 182/2.6
4,633,975 A * 1/1987 Connor ..... E01D 19/106 182/2.6
4,646,875 A * 3/1987 Sholl ..... E01D 19/106 212/347
4,690,247 A * 9/1987 Yoshida ..... B66F 11/046 182/148
4,696,371 A * 9/1987 Moog ..... E01D 19/106 182/62.5
5,200,674 A * 4/1993 Fujimoto ..... B66F 11/046 318/105
5,253,731 A * 10/1993 Moog ..... E01D 19/106 182/2.6
5,318,149 A * 6/1994 Moog ..... E01D 19/106 182/62.5
5,435,410 A * 7/1995 Langston ..... B66F 11/044 182/2.6
5,617,931 A * 4/1997 Zygmun ..... E04G 3/30 182/150
5,713,430 A * 2/1998 Cohen ..... E04G 3/34 182/36
5,845,739 A * 12/1998 Ohtsuki ..... E04G 3/34 182/142
6,598,702 B1 * 7/2003 McGillewie, Jr. .... E01D 19/106 182/62.5
7,407,150 B1 * 8/2008 Bellantoni ..... B66C 13/08 254/285
7,926,670 B2 * 4/2011 Schneider ..... B66F 11/046 182/2.11
8,070,134 B1 * 12/2011 Bellantoni ..... B63C 3/06 254/284
8,443,936 B1 5/2013 Raymond
8,584,803 B2 * 11/2013 Sani ..... E04G 3/30 182/112
9,245,434 B2 * 1/2016 Baillargeon ..... G08B 25/08
9,695,024 B2 * 7/2017 Herauf ..... E01D 19/106
10,988,362 B2 * 4/2021 Araki ..... B66F 9/06
2003/0221916 A1 * 12/2003 Dube ..... B66F 11/042 187/391
2004/0026171 A1 * 2/2004 Chang ..... A62B 1/02 182/145
2006/0080904 A1 * 4/2006 Shaha ..... E04H 6/42 52/79.1
2008/0283334 A1 * 11/2008 Fickey ..... A01M 31/02 182/20
2011/0088970 A1 * 4/2011 Beji ..... B66F 11/04 182/63.1
2016/0214842 A1 * 7/2016 Herauf ..... B66F 11/044
2016/0287918 A1 * 10/2016 Huehn ..... A62C 27/00
2019/0256335 A1 * 8/2019 Araki ..... B66F 13/00
2020/0207600 A1 * 7/2020 Bonnefoy ..... B66F 11/044
2021/0029986 A1 * 2/2021 Bouchard ..... E04G 3/32
2022/0048748 A1 * 2/2022 Corbett ..... B66F 9/07581

FOREIGN PATENT DOCUMENTS

JP H07178188 A 7/1995
JP 2003128392 5/2003
JP 2009228358 10/2009
JP 2014108881 6/2014
JP 2016030986 3/2016

OTHER PUBLICATIONS

PCT International Written Opinion dated Oct. 2, 2018 for corresponding PCT International Application No. PCT/JP2018/026296, no English translation (4 pages).
Extended European Search Report corresponding to European Patent Application No. 18832779.5 (6 pages) (dated Dec. 17, 2021).

* cited by examiner

WORK GONDOLA APPARATUS AND WORK VEHICLE PROVIDED WITH SAME

CROSS REFERENCE TO RELATED APPLICATIONS

This application is a continuation-in-part of International Patent Application No. PCT/JP2018/026296, filed Jul. 12, 2018, which claims the benefit of Japanese Patent Application No. 2017-136504, filed Jul. 12, 2017, the entire content of each is incorporated herein by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

TECHNICAL FIELD

The present invention relates to a work gondola apparatus and a work vehicle provided with the same.

Specifically, work site constraints have been eliminated by means of the battery-driven work gondola apparatus. In particular, by the work gondola apparatus being mounted on the work vehicle, the work vehicle is capable of traveling to any structure such as a road bridge and capable of, for example, inspecting and repairing the entire wall surface of a bridge pier and the like.

BACKGROUND ART

At present, a work gondola apparatus provided with a work cage allowing a worker to board and suspended by means of a cable such as a wire installed on a rooftop is used so that work at height on a wall surface or the like is performed with safety and efficiency in the case of, for example, the construction, repair, and inspection of a structure such as a building, a ship, a power plant, a tank, a chimney, and a bridge.

In the work gondola apparatus, a worker works on the wall surface while lowering the work cage from the rooftop by changing the position of the cable wound around the sheave of an endless winder (for example, Patent Document 1).

In the case of inspection and repair of a road bridge and the like, the work gondola apparatus is provided with an arm mechanism moving a tip part to a desired position by combining vehicle-mounted turning, telescopic, and derricking mechanisms and a vehicle for work at height (bridge inspection vehicle) is used with the work cage installed at the tip of the arm mechanism.

In the vehicle for work at height, for example, the tip of the arm mechanism is moved from the top of a road to a working position and a worker works from the work cage provided at the tip part (for example, Patent Document 2).

CITATION LIST

Patent Document

Patent Document 1: Japan Laid-Open Patent Application Publication No. 2009-228358

Patent Document 2: Japan Laid-Open Patent Application Publication No. 2003-128392

SUMMARY OF THE INVENTION

Technical Problem

It is an object of the present invention to solve the problems of the above-mentioned prior arts.

Means for Solving the Problems

One aspect of the present invention provides a work gondola apparatus, comprises: a work cage into which a worker boards; equipment mounting parts disposed on both outer sides of the work cage; battery-driven elevating/lowering mechanisms which are mounted to the respective equipment mounting parts and which elevate/lower the work cage to a working location by means of cables that are being suspended; and batteries for driving the respective elevating/lowering mechanisms, wherein the battery is provided with an auxiliary battery and the auxiliary battery is configured to be capable of simultaneously driving the elevating/lowering mechanisms on both sides, and the equipment mounting parts are configured so as to substantially keep the weight balance between the right and left sides.

DETAILED DESCRIPTION

Figure 1:
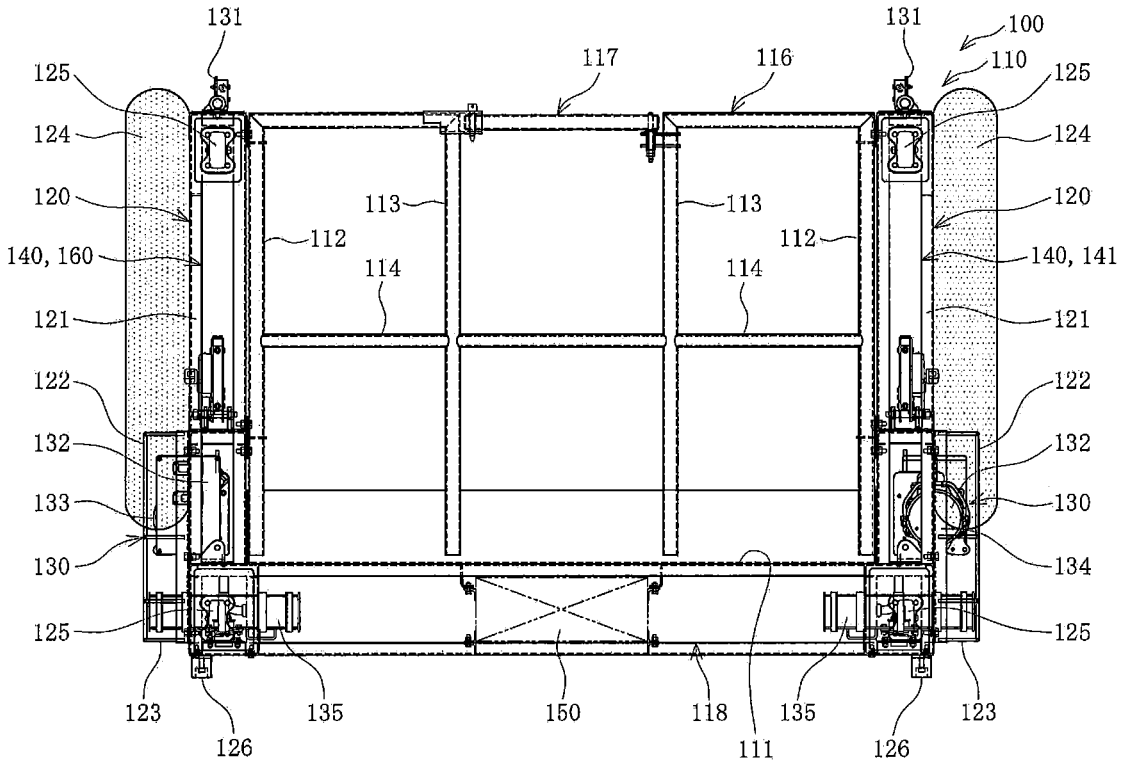
FIG. 1 is a front view according to an embodiment of a work gondola apparatus of the invention.
Figure 2:
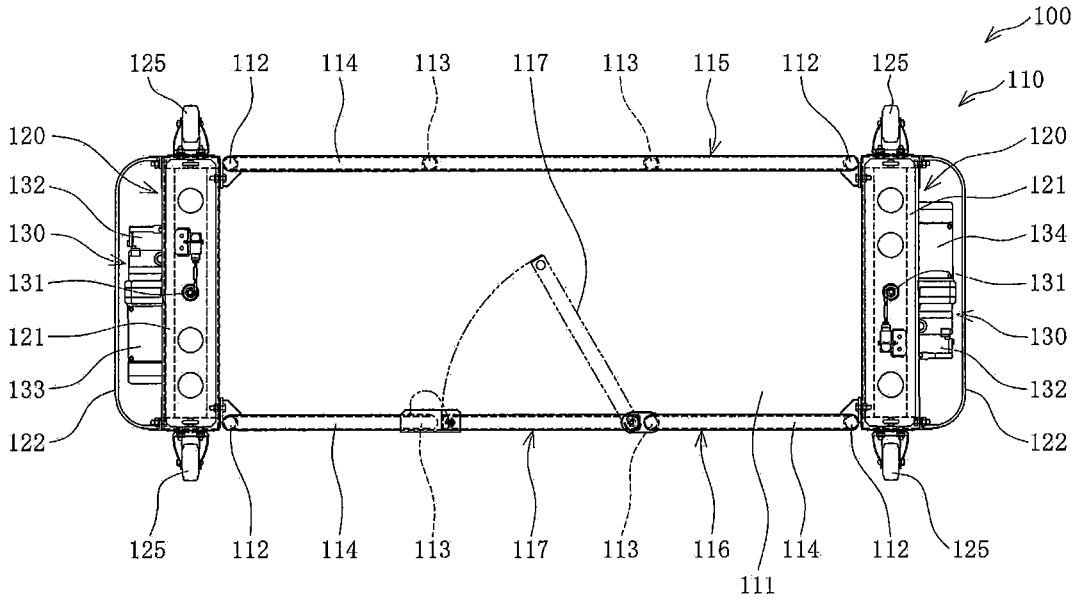
FIG. 2 is a plan view according to the embodiment of the invention.
Figure 3:
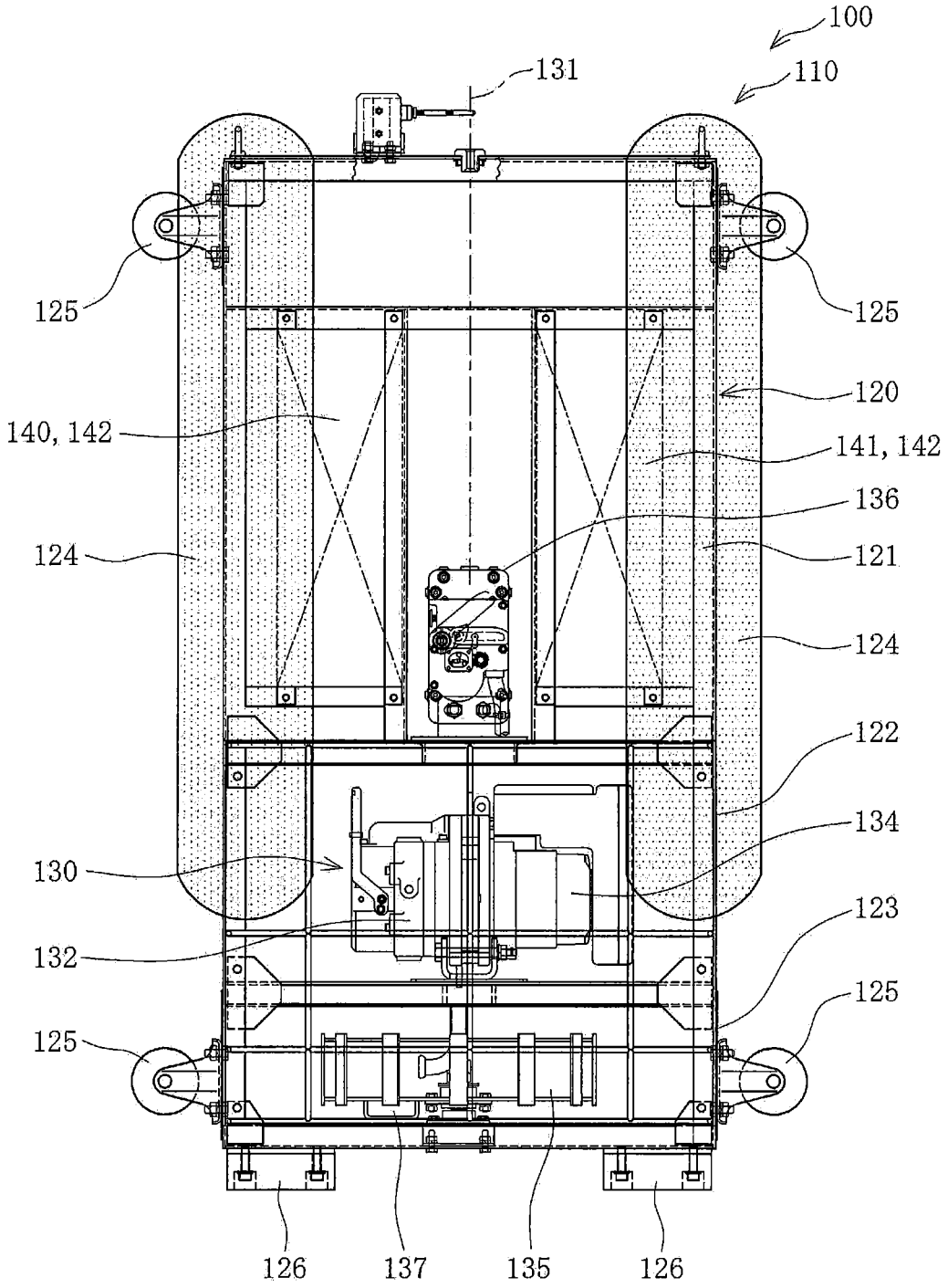
FIG. 3 is a right side view according to the embodiment of the invention.
Figure 4A:
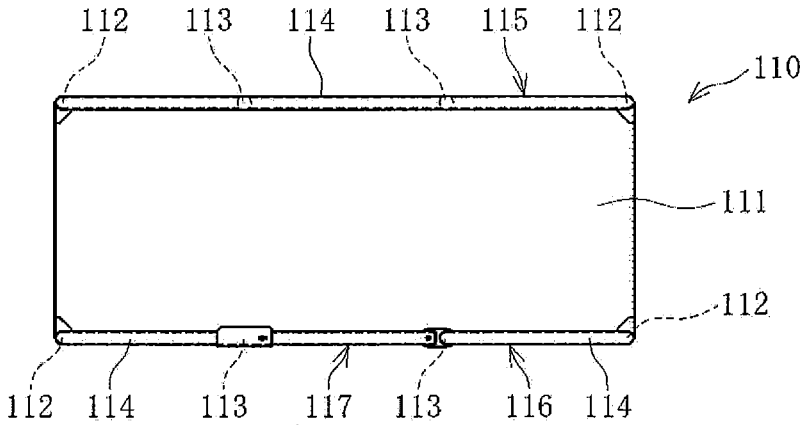
FIG. 4A is a plan view of a work cage according to the embodiment of the invention.
Figure 4B:
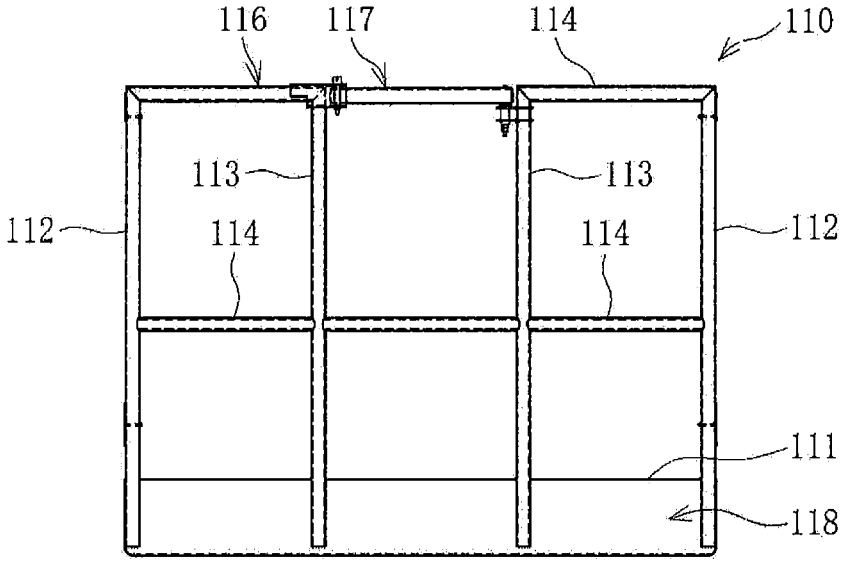
FIG. 4B is a front view according to the embodiment of the invention.
Figure 4C:
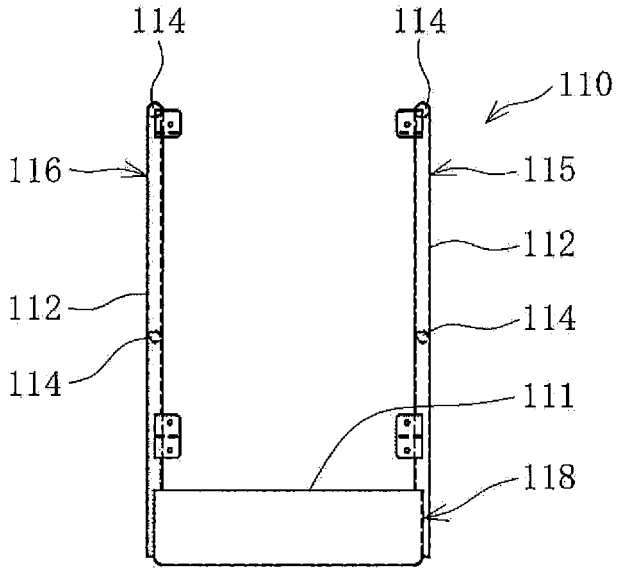
FIG. 4C is a right side view according to the embodiment of the invention.

Hereinafter, an embodiment of a work gondola apparatus of the invention will be described in detail with reference to accompanying drawings.

As illustrated in FIGS. 1 to 6, a work gondola apparatus 100 is provided with a work cage 110 into which a worker boards, equipment mounting parts 120 disposed on both outer sides of the work cage 110, battery-driven elevating/lowering mechanisms 130 which are mounted to the respective equipment mounting parts 120 and which elevate/lower the work cage 110 to a working location by means of cables 131 that are being suspended, and batteries 140 for driving the respective elevating/lowering mechanisms 130. The equipment mounting parts 120 are configured so as to substantially keep the weight balance between the right and left sides.

The work cage 110 is provided with a work floor 111 onto which a worker boards. For example, the work floor 111 is formed in a rectangular shape having a long side along a work surface and short in the direction perpendicular to the work surface (depth direction). Posts 112 are erected at the four corners of the work floor 111 and two intermediate posts 113 are disposed at substantially equal intervals in the longitudinal intermediate portion. Horizontal members 114 are fastened to the upper end parts of the intermediate posts 113 and the post 112 on the work surface side and the intermediate portion in the up-down direction. As a result, a lattice frame-shaped front frame 115 is formed. A rear frame 116 disposed on the side opposite to the work surface with respect to the front frame 115 is provided with a lattice frame-shaped opening/closing frame 117 provided between the two intermediate posts 113 and attached to one of the intermediate posts 113 by means of a hinge. The opening/closing frame 117 can be opened/closed inside the work cage 110 and is fixed to and held by the rear frame 116 by means of a lock fitting.

In other words, the work cage 110 has a space surrounded by the work floor 111 for a worker to board and work and the front frame 115 and the rear frame 116 in front of and behind the work floor 111 and the worker can move freely and work on the work floor 111 with no load in the space.

The shape of the work floor 111 is not limited to the rectangular shape. The work floor 111 can be formed in a shape corresponding to the shape of the work surface such as a circular arc shape.

On the lower side of the work floor 111, a bottom frame 118 provided integrally with the work cage 110 is disposed at a distance from the work floor 111. An accommodating space accommodating a control panel 150 and the like is formed between the bottom frame 118 and the work floor 111. The control panel 150 controlling the operation of the elevating/lowering mechanism 130 and the like is mounted on the bottom frame 118. The control panel 150 is mounted on the middle portion of the bottom frame 118 in order to ensure the weight balance between the right and left sides of the work cage 110.

The equipment mounting parts 120 are disposed on both sides of the work cage 110. Mounted on the equipment mounting parts 120 is equipment necessary for the operation of the work gondola apparatus 100 such as the elevating/lowering mechanism 130, the battery 140, an auxiliary battery 141, and an operation panel 160.

The equipment mounting parts 120 are provided with box-shaped main frame parts 121 each configured to double as the two posts 112 on both sides of the work cage 110. The work gondola apparatus 100 can be configured by the main frame parts 121 being connected to both sides of the work cage 110 and as a unit regardless of the size of the work cage 110 (size of the work floor 111).

The front-rear width of the main frame part 121 of the equipment mounting part 120 is equal to the front-rear width (depth) of the work floor 111. The left-right width of the main frame part 121 of the equipment mounting part 120 is smaller than the depth in accordance with the sizes of two battery boxes 142 accommodating the batteries 140, the battery box 142 accommodating one auxiliary battery 141, and the operation panel 160. The main frame part 121 has the same configuration on the right and left.

A protective frame part 122 protruding laterally from the main frame part 121 (in a direction along the work surface) is provided integrally with the main frame part 121 below the middle of the main frame part 121 such that an endless winder 132 of the elevating/lowering mechanism 130 can be mounted. The protective frame part 122 ensures a mounting space that is in accordance with the size (left-right width) of the endless winder 132.

The bottom parts of the equipment mounting parts 120 are provided with box frame-shaped bottom frame parts 123 connected to the bottom frame 118 of the work cage 110. Winding reels 135 for respectively winding the two cables 131 are rotatably attached to the bottom frame parts 123. By the cable 131 being pushed in or pulled out via the endless winder 132, the cage-shaped winding reel 135 can be rotated and the cable 131 can be accommodated in a coil shape.

A material ensuring sufficient strength to endure equipment mounting, such as a steel material, is selected as the material of the main frame part 121, the protective frame part 122, the bottom frame part 123, and the like that constitute the equipment mounting part 120.

In contrast, the work cage 110 described above can be formed of an aluminum material, a synthetic resin material, or the like or can be formed in combination with a steel material insofar as the work cage 110 ensures strength for a worker to be able to work with safety. As a result, weight reduction can be achieved as compared with a case where a steel material or the like is used.

The outside corner part of the equipment mounting part 120 is formed in a circular arc shape in plan view and is not square. A buffer 124 is attached to the corner part so as to cover the corner part from above and below. The buffer 124 is an elastic material such as sponge wrapped in a sheet or the like.

On and beneath the front and rear surfaces of the main frame parts 121, four pressure rollers 125 are attached on one side (front surface side) and eight in total on both sides (front and rear surface sides). In a case where the work gondola apparatus 100 is elevated/lowered along the work surface or the like, contact between the work cage 110 and the equipment mounting part 120 is prevented by the pressure rollers 125 being rolled against the work surface.

At the bottom parts of the bottom frame parts 123, two rubber legs 126 are attached to the front and the back of the bottom frame part 123 on each side. The work cage 110 and the equipment mounting part 120 are placed and supported on, for example, a floor surface by the four rubber legs 126.

The elevating/lowering mechanisms 130 are respectively mounted on the main frame parts 121 of the right and left equipment mounting parts 120 and the two endless winders 132 and the like constitute the elevating/lowering mechanisms 130. The weight balance between the right and left equipment mounting parts 120 is ensured as a result.

The cable 131 suspended from a structure, a suspension frame, or the like is wound around the sheave of the endless winder 132, and it is possible to elevate/lower the work cage 110 while moving the winding position of the cable 131 by means of the frictional force between the cable 131 and the sheave of the endless winder 132.

The endless winders 132 are provided with battery-driven motors 133 and 134, respectively. The left and right motors 133 and 134 are controlled and operated by the control panel 150 and the operation panel 160.

One of the equipment mounting parts 120 is provided with the two battery boxes 142 respectively accommodating the battery 140 and the auxiliary battery 141. Each of the battery boxes 142 can be opened/closed from the work cage 110 side about the lower end part and is installed such that the battery 140 and the auxiliary battery 141 can be replaced.

The battery box 142 accommodating the battery 140 and the operation panel 160 are installed in the other equipment mounting part 120. This battery box 142 can be opened/closed from the work cage 110 side about the lower end part as well and is installed such that the battery 140 can be replaced.

The operation panel 160 is for operating the elevating/lowering mechanism 130 via the control panel 150. The operation panel 160 has an operation surface disposed toward the work cage 110 side. The operation panel 160 can be opened/closed about one side end part and inspection or the like can be performed from the work cage 110 side.

The operation panel 160 is configured such that only an operation is performed by a control function being distributed to the control panel 150 mounted on the bottom frame 118 of the work cage 110 and has substantially the same weight as one auxiliary battery 141. Even when the weight of the operation panel 160 is regulated, the control panel 150 can be installed without considering the weight balance and the weight itself by being installed in the middle portion of the work cage 110.

In this manner, the weight balance between the right and left equipment mounting parts 120 can be substantially ensured.

Although the two batteries 140 and the auxiliary battery 141 are distinguished for convenience of description, batteries of the same specification such as lithium-ion batteries can be used. The auxiliary battery 141 may be different in specification with the right and left batteries 140 having the same specification. In this case, the weight balance between the auxiliary battery 141 and the operation panel 160 can be substantially ensured.

Figure 7:
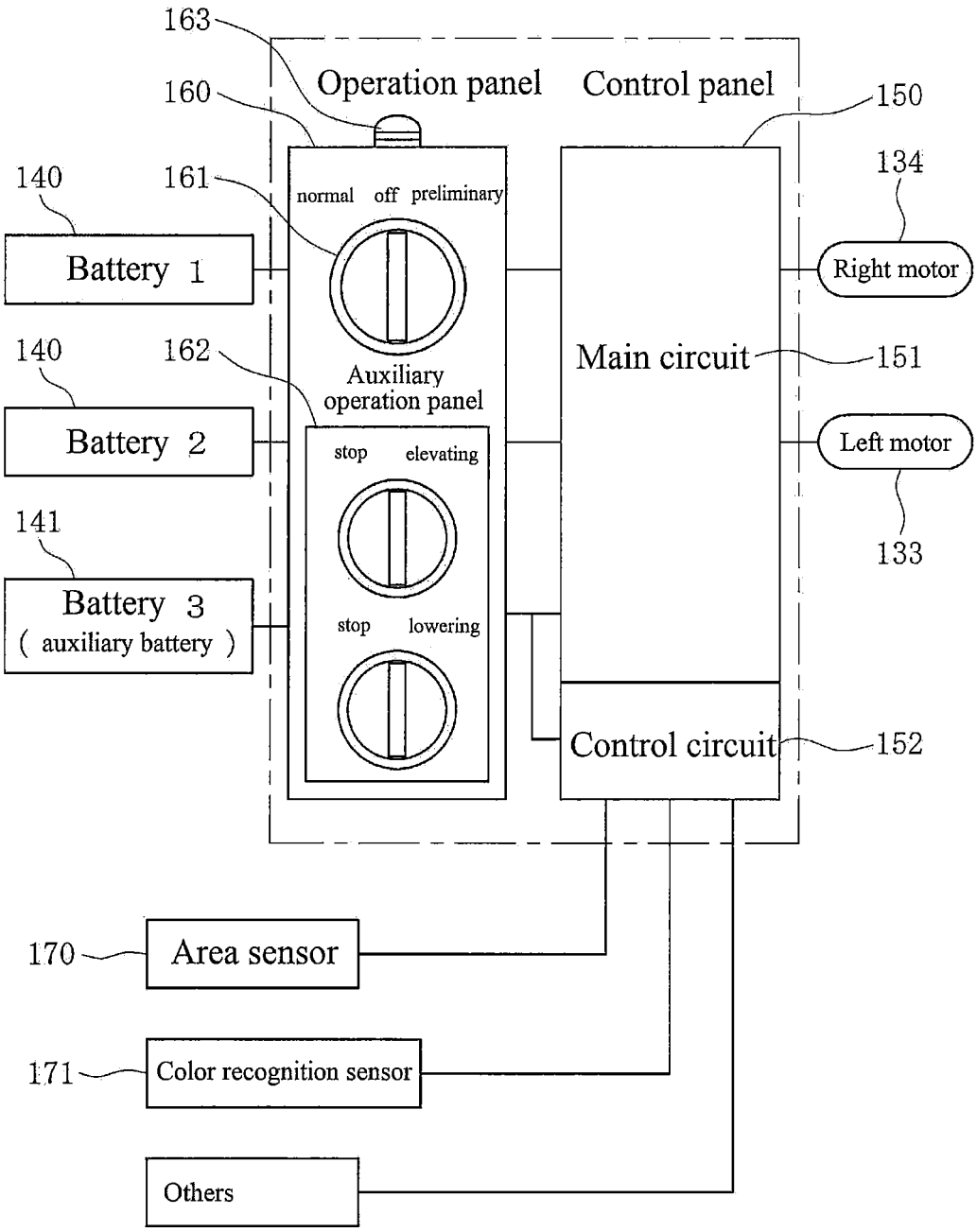
FIG. 7 is an explanatory diagram of a control panel and an operation panel according to the embodiment of the invention.
Figure 8A:
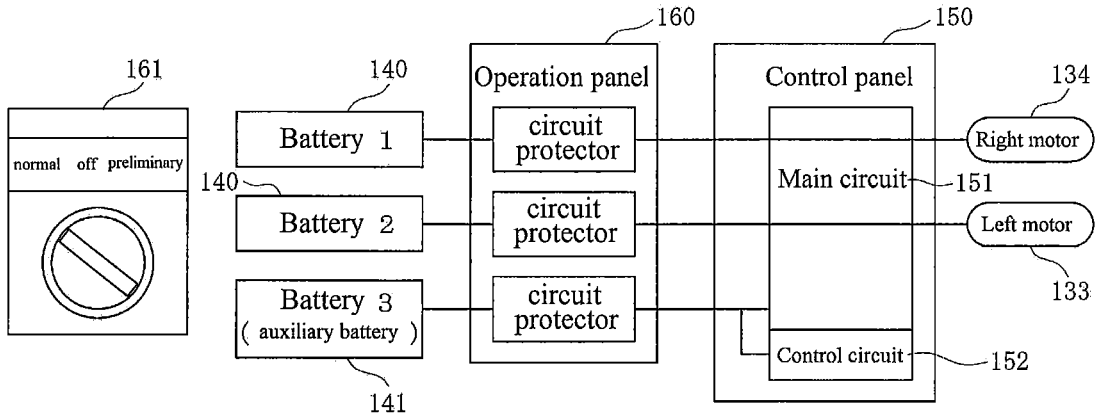
FIG. 8A is an explanatory diagram of a switching state where a battery according to the embodiment of the invention is switched to normal.
Figure 8B:
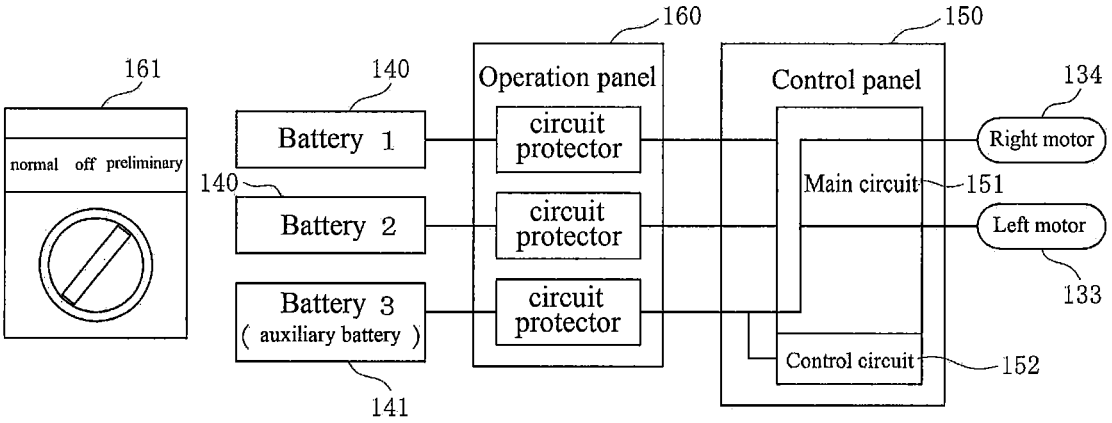
FIG. 8B is an explanatory diagram of a switching state where the battery according to the embodiment of the invention is switched to preliminary.

The control panel 150 and the operation panel 160 perform emergency stop in addition to control such as the operation (elevating/lowering) and stop operation and automatic stop of the left and right motors 133 and 134 of the elevating/lowering mechanism 130. The control panel 150 is provided with a main circuit 151 and a control circuit 152 as illustrated in FIGS. 7, 8A, and 8B. The operation panel 160 is provided with a changeover switch 161 switching between a normal operation (normal) and an operation (preliminary) led by the auxiliary battery 141, an auxiliary operation panel 162 carried into the work cage 110 and performing elevating and lowering operations, and an emergency stop button 163 for emergency stop.

The battery 140 mounted on the left equipment mounting part 120 is connected to the left motor 133 via the circuit protector of the operation panel 160 and the main circuit 151 of the control panel 150. Likewise, the battery 140 mounted on the right equipment mounting part 120 is connected to the right motor 134 via the operation panel 160 and the control panel 150.

A regenerative current can be recovered to the batteries 140 from the motors 133 and 134 for driving the endless winder 132. Energy can be saved as a result.

The auxiliary battery 141 is connected to the left and right motors 133 and 134 via the circuit protector of the operation panel 160 and the main circuit 151 of the control panel 150 and is further connected to the control circuit 152. As a result, the auxiliary battery 141 is capable of supplying electric power to the control circuit 152 in a normal state and is capable of simultaneously supplying electric power to the left and right motors 133 and 134 in addition to electric power supply to the control circuit 152 in a preliminary state.

The emergency stop button 163 is installed at a position on the upper surface of the operation panel 160 facilitating an operation in an emergency. Once operated, the emergency stop button 163 immediately stops the left and right motors 133 and 134.

The operation of the left and right motors 133 and 134 of the elevating/lowering mechanism 130 by the control panel 150 and the operation panel 160 is performed as follows.

In the case of a normal operation, the changeover switch 161 of the operation panel 160 is switched from "off" to "normal".

In this normal state, control is performed such that electric power is supplied from the left battery 140 to the left motor 133. Likewise, control is performed such that electric power is supplied from the right battery 140 to the right motor 134. Also, an operation command for elevating or lowering from the auxiliary operation panel 162 of the operation panel 160 is sent to the control panel 150 (see FIG. 8A).

As a result, the work cage 110 and the equipment mounting part 120 integrated with the work cage 110 are elevated or lowered by the right and left endless winders 132 while maintaining a substantially horizontal state.

Once the work cage 110 is elevated/lowered to the working location, a worker conducts the stop operation by using the auxiliary operation panel 162 and conducts a predetermined work.

After the work at one place is completed, the worker conducts the operation for elevating or lowering again, stops the work cage 110 at the next working location, and repeats the predetermined work.

By the elevating/lowering of the work cage 110 being repeated in this manner, the battery 140 is exhausted, a difference occurs in the drive force of the endless winder 132 by the left and right motors 133 and 134, and a phenomenon such as slight tilting of the work cage 110 occurs.

Once the work cage 110 tilts as described above, the worker stops the elevating/lowering, recognizes the exhaustion of the battery 140, and switches the changeover switch 161 of the operation panel 160 to "preliminary" (see FIG. 8B).

The switching of the changeover switch 161 results in a preliminary state where electric power can be simultaneously supplied to the left and right motors 133 and 134 from the auxiliary battery 141. In the preliminary state, the worker performs an elevating or lowering operation such that the work cage 110 is returned to the origin position of the work cage 110 and charges or replaces the battery 140 to prepare for the next work.

In the preliminary state, the elevating/lowering speed of the work cage 110 is reduced as the two motors 133 and 134 on the left and right are driven by one auxiliary battery 141, and yet the work cage 110 can be returned to the origin position without manual handle-based driving of the endless winder 132.

The exhaustion of the battery 140 may be recognized by a charging amount detection sensor (not illustrated) being provided in the battery 140 instead of the tilting of the work cage 110. The left and right motors 133 and 134 may be automatically stopped by a detection signal from the charging amount detection sensor being input to the control circuit 152.

The work cage 110 may be provided with a tilt sensor (not illustrated) and the left and right motors 133 and 134 may be automatically stopped by a detection signal from the tilt sensor being input to the control circuit 152. In addition, without being limited thereto, another sensor detecting the exhaustion of the battery 140 may be provided for the left and right motors 133 and 134 to be automatically stopped.

The work gondola apparatus 100 is provided with a gripping device 136 (see FIGS. 3, 5, and 6) for automatic stop in an emergency as in the case of existing work gondola apparatuses. The gripping device 136 functions as a safety device by, for example, stopping the work gondola apparatus 100 by pinching the cable 131 in a case where the lowering speed exceeds a set speed.

The work gondola apparatus 100 is provided with an area sensor 170 (see FIG. 5A) in order to detect a work-related obstacle. The area sensor 170 is attached to the bottom frame part 123 of the equipment mounting part 120 with a detection unit directed downward. A detection signal from the area sensor 170 is input to the control circuit 152 of the control panel 150. The control circuit 152 performs control such that elevating/lowering is stopped by a stop command for the left and right motors 133 and 134 being output based on the detection signal of the area sensor 170.

The area sensor 170, for example, is a scan type obstacle detection sensor or the like, scans a semicircular region with a light emitting diode (LED) beam, calculates coordinates by measurement of the distance to the obstacle and the angle of the obstacle, and detects the obstacle in a set area.

In the related art, an obstacle detection bar is installed so as to protrude from the work cage 110 and an obstacle is detected by a detection signal being obtained from the obstacle detection bar when mechanical contact occurs between the obstacle detection bar and the obstacle such as a protruding part protruding from a ground surface, a road, a building in the middle of elevating/lowering, or the like. In contrast, the area sensor 170 is capable of detecting the obstacle in a set region in a non-contact state and is capable of performing the detection even when the set region includes, for example, planting (a place covered with trees) or a sea or river surface. As a result, even in a case where the work gondola apparatus 100 is applied to an inspection work for a road, a bridge pier, or the like, the area sensor 170 is capable of detecting the obstacle with reliability and is capable of automatically stopping the elevating/lowering of the work cage 110 once the obstacle is detected.

Figure 5A:
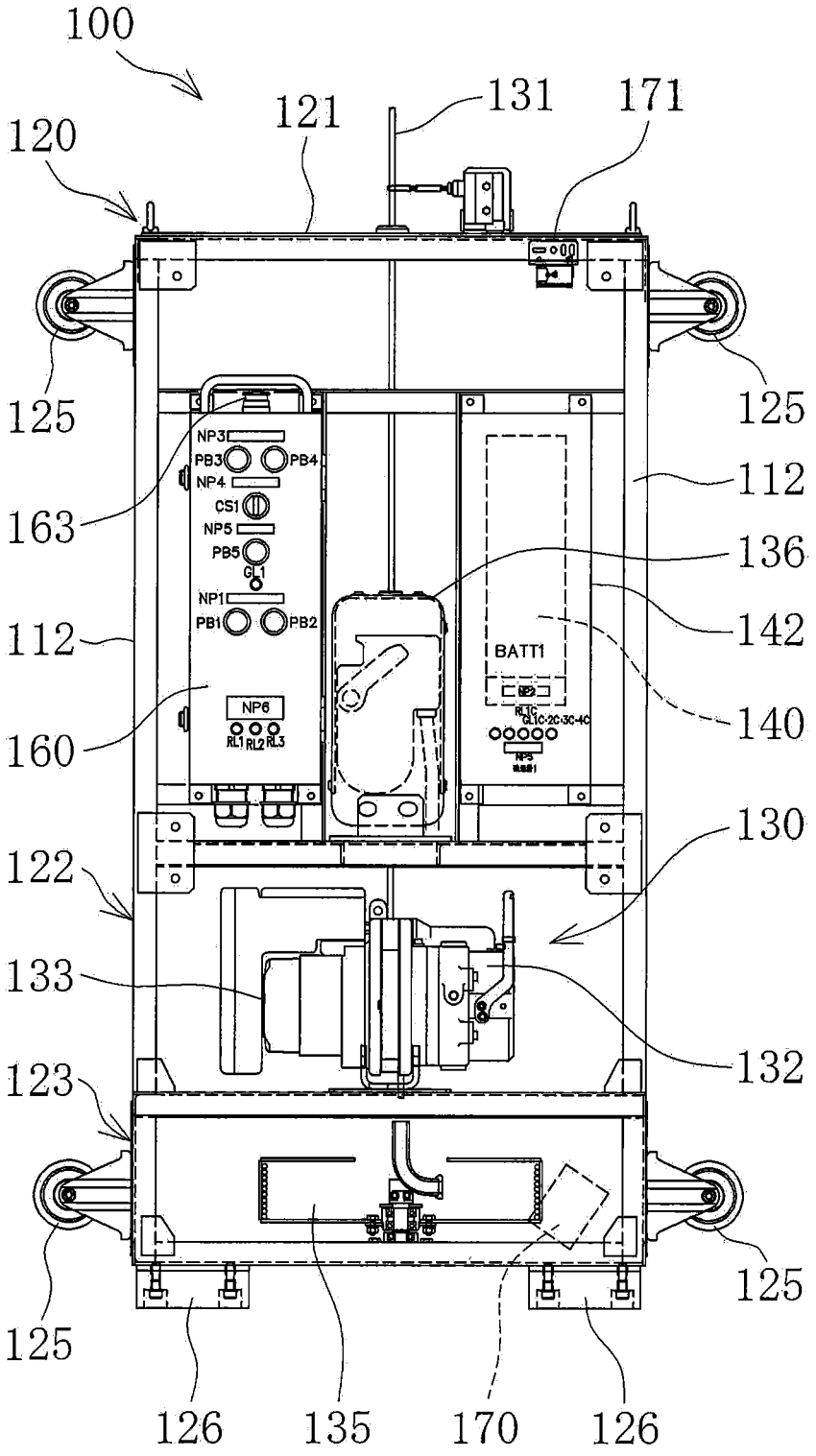
FIG. 5A is a side view of a left equipment mounting part according to the embodiment of the invention.
Figure 5B:
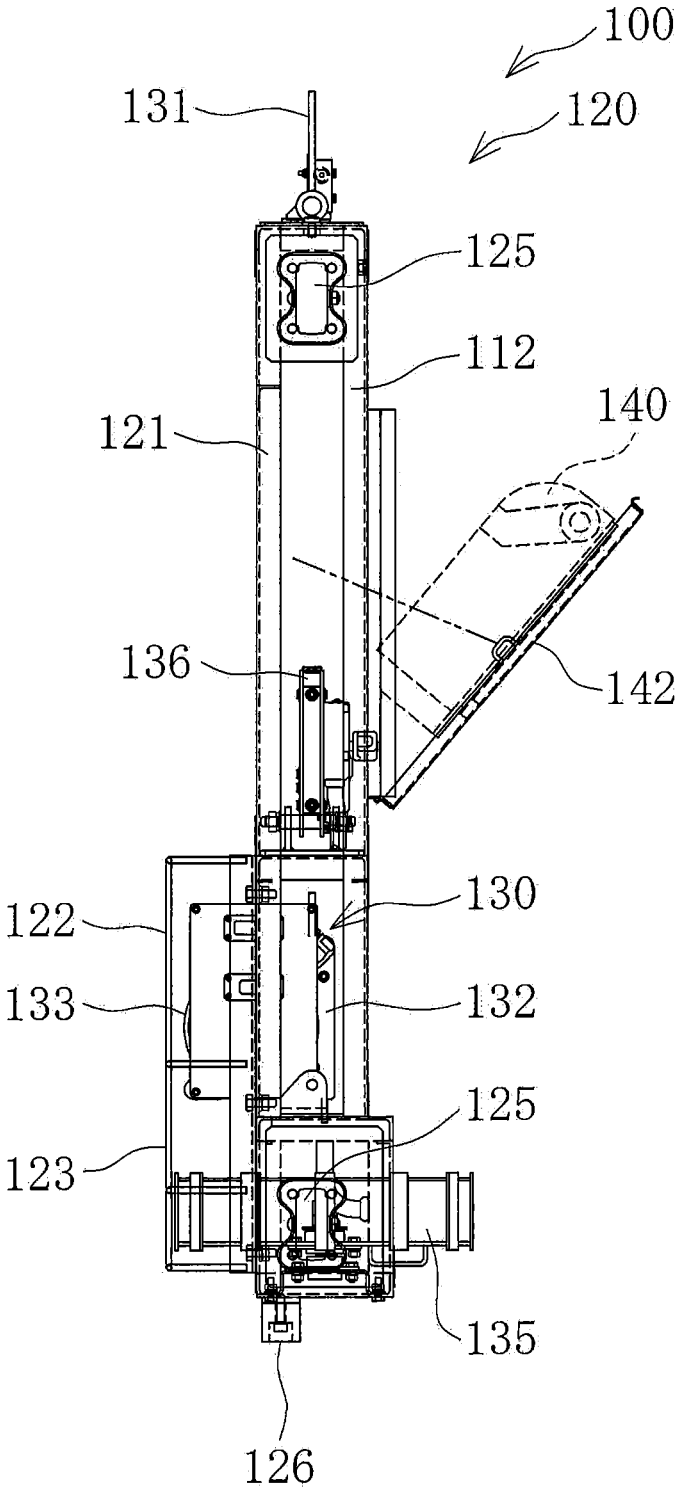
FIG. 5B is a front view of the left equipment mounting part according to the embodiment of the invention.
Figure 6A:
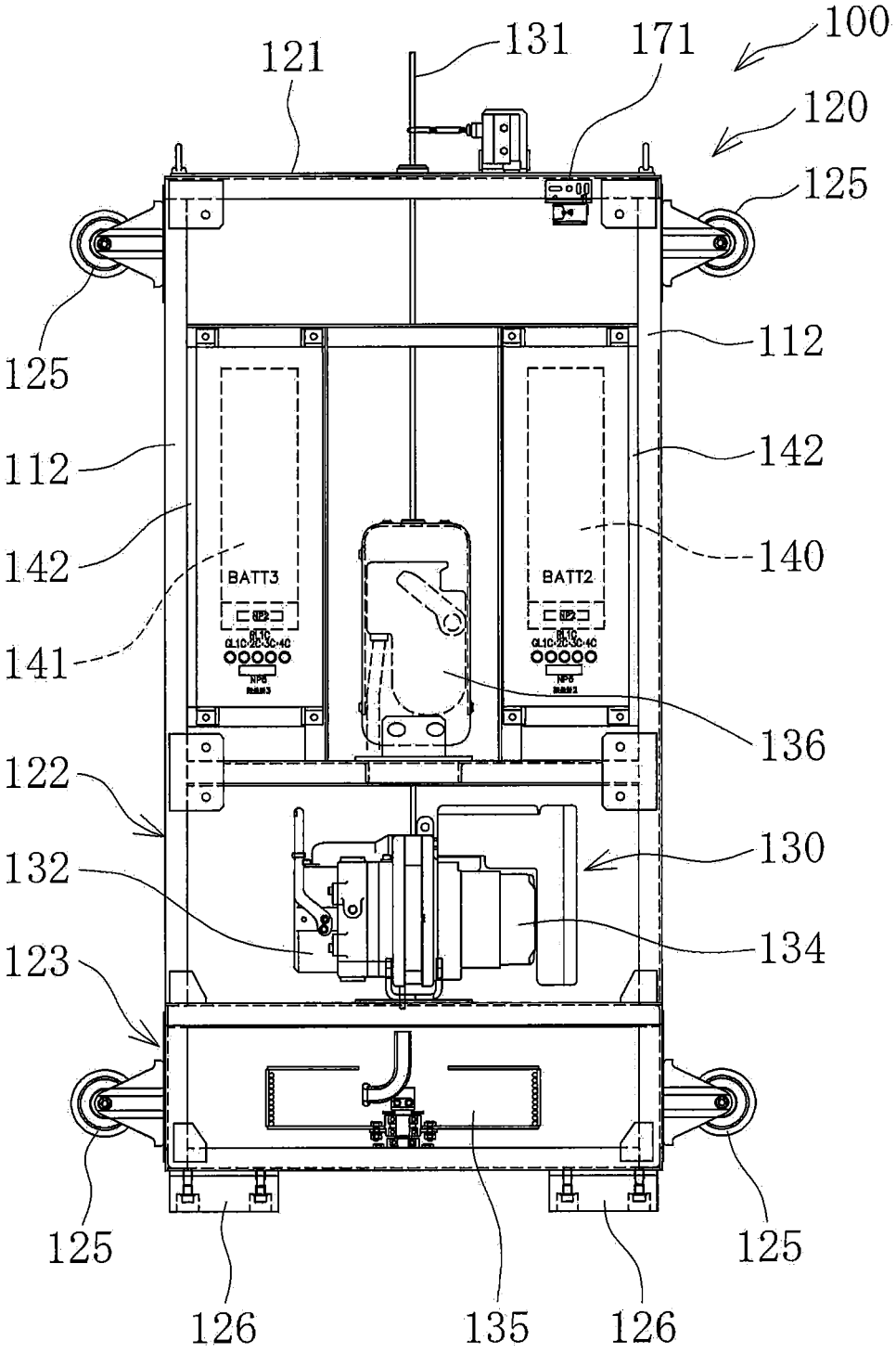
FIG. 6A is a side view of a right equipment mounting part according to the other embodiment of the invention.
Figure 6B:
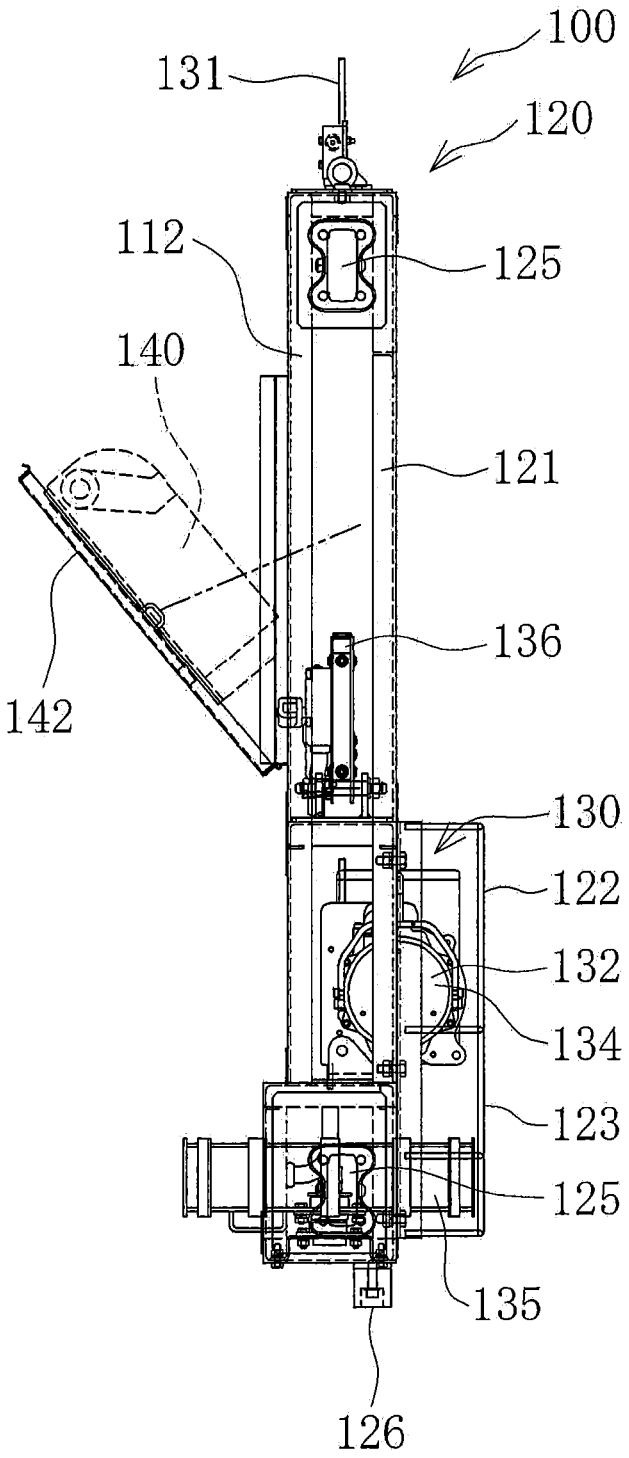
FIG. 6B is a front view of the right equipment mounting part according to the other embodiment of the invention.

The work gondola apparatus 100 is provided with a colored part of the cable 131 and a color recognition sensor 171 recognizing the color of the colored part in order to detect the lower limit position of the work cage 110 related to the work (see FIG. 5A). The color recognition sensor 171 is attached to the main frame part 121 of the equipment mounting part 120 and toward each cable 131. A detection signal of the color recognition sensor 171 is input to the control circuit 152 of the control panel 150. The control circuit 152 receives the detection signal of the color recognition sensor 171, outputs a stop command to the left and right motors 133 and 134, and performs control such that the elevating/lowering of the work cage 110 is stopped.

A white spot photoelectric sensor having a built-in amplifier or the like is used as the color recognition sensor 171. The sensor applies a white LED to the cable 131 in a spot shape, receives the light from the cable 131 by means of a light receiving element, and determines the coloring of the cable 131.

Coloring is applied to the vicinity of the lower end part of the cable 131. For example, the coloring is applied in red. Once the color recognition sensor 171 detects that the red part of the cable 131 is an elevating/lowering limit lift, the color recognition sensor 171 performs control such that the elevating/lowering of the work cage 110 is stopped by a stop command being output to the left and right motors 133 and 134.

Also possible is a worker recognizing the outline of the current working location by a plurality of different colors being applied to the cable 131 at predetermined intervals or the same color being applied to the cable 131 at predetermined intervals. In this case, a worker may be able to recognize the current working location with reliability by, for example, a warning sound corresponding to each color being generated in a speaker (not illustrated) or the warning sound being generated with the number of times of warning sound generation changed by means of the detection signal of the color recognition sensor 171.

A retaining device 137 (see FIG. 3) is provided at the lower end part of the cable 131 so that the cable 131 is mechanically prevented from falling from the endless winder 132 and safety is ensured in an emergency.

The work gondola apparatus 100 is provided with various safety devices similarly to the gondola apparatus of the related art. Examples of the safety devices include an upper limit switch for automatic stop at an upper limit position.

As for the work gondola apparatus 100 configured as described above, in a case where work is performed on an outer wall surface of a structure, the upper ends of the two cables 131 are fixed to the upper end part of the outer wall surface of the structure by means of a fixing metal fitting or the like and the cables 131 are suspended. Then, the lower ends of the respective cables 131 are wound around the sheaves of the endless winders 132 mounted on the equipment mounting parts 120 provided on both sides of the work cage 110 of the work gondola apparatus 100. As a result, the cables 131 can be guided into the winding reels 135 and wound and can be unwound out of the winding reels 135.

After the work is prepared in this manner, a worker enters the work cage 110 and operates the operation panel 160 and the auxiliary operation panel 162. As a result, the left and right motors 133 and 134 of the endless winder 132 of the elevating/lowering mechanism 130 are driven and the worker performs the work at each working location by repeatedly elevating/lowering the work cage 110 to the working location.

In the work gondola apparatus 100, the two batteries 140 drive the left and right motors 133 and 134 independently of each other during the normal operation. Once either of the two batteries 140 is exhausted, the worker switches to the auxiliary battery 141 and the left and right motors 133 and 134 are controlled so as to be driven at the same time.

Work site constraints are eliminated by the battery driving. In addition, work is possible in a stable state and without right and left tilting.

In the work gondola apparatus 100, no load is present in the work cage 110, and thus a worker can freely move and work in the work cage 110 at each working location.

Equipment such as the elevating/lowering mechanism 130 of the work gondola apparatus 100 is mounted on the equipment mounting part 120, and thus strength with respect to a mounting load may be ensured by the equipment mounting part 120. Accordingly, the work cage 110 can be a structure corresponding to the weight with respect to a worker's boarding and it is possible to reduce the overall weight as compared with a case where the entire structure including the work cage 110 is a rigid structure by aluminizing or resinifying the work cage 110.

It is not necessary to mount the elevating/lowering mechanism 130 and the like on the work cage 110, and thus it is possible to constitute the work gondola apparatus 100 by connecting the equipment mounting parts 120 to both sides of the work cage 110 regardless of the size of the work cage 110. With this configuration, the two equipment mounting parts 120 and the work cage 110 can be formed as one unit and specifications such as the size of the work cage 110 can be changed with ease.

In the work gondola apparatus 100, the motors 133 and 134 for driving the endless winders 132 of the elevating/lowering mechanisms 130 are driven by the batteries 140 and the auxiliary battery 141. Accordingly, it is not necessary to attach an electric power supply cable or an operation cable to the upper end part of a structure or the like, high lift work can be handled with ease, and work can be performed with the effect of wind and the like minimized.

The left and right motors 133 and 134 are respectively driven by the two batteries 140 during the normal operation and the left and right motors 133 and 134 are simultaneously driven by the auxiliary battery 141 once the battery 140 is exhausted. Accordingly, the equipment mounting part 120 can be compact and further weight reduction can be achieved.

The auxiliary battery 141 and the operation panel 160 are mounted on the right and left equipment mounting parts 120 such that the weight balance is ensured. Accordingly, tilting of the work cage 110 can be suppressed, no uneven tension is applied to each of the cables 131, and a worker can work with safety.

The battery boxes 142 of the batteries 140 and the auxiliary battery 141 can be replaced by opening/closing from the work cage 110 side, and thus a worker can easily replace the battery 140 and the auxiliary battery 141 and can work with efficiency.

The work gondola apparatus 100 is provided with the area sensor 170, and the area sensor 170 detects an obstacle. Accordingly, the work gondola apparatus 100 provided with the area sensor 170 is capable of detecting an obstacle even on a sea surface and the like and in planting and is capable of allowing a worker to work with an obstacle detected regardless of work places as compared with a case where a contact obstacle is detected by means of the obstacle detection bar of the related art.

The work gondola apparatus 100 detects the lower limit position of the work cage 110 by means of the coloring in the vicinity of the lower end part of the cable 131 and the color recognition sensor 171 recognizing the coloring. Accordingly, the necessary lift varies with work places and, even in the event of lowering with respect to a place exceeding the effective length of the cable 131, the left and right motors 133 and 134 receive a stop command before the lower limit position is reached and the elevating/lowering of the work cage 110 can be stopped. As a result, even in a case where the lower limit position of the work place is covered with trees and the like and is not clearly grasped, it is possible to work with safety within the range of the effective length of the cable 131.

Next, an embodiment of a work vehicle provided with the work gondola apparatus of the invention will be described with reference to FIGS. 9, 10A, and 10B.

A work vehicle 1 provided with the work gondola apparatus 100 is provided with the work gondola apparatus 100, an arm mechanism 60 moving a tip part to a desired position by combining a turning mechanism 30, a telescopic mechanism 40, and a derricking mechanism 50 mounted on a vehicle body 20, a vertically extending support post 70 provided at the tip part of the arm mechanism 60, and a suspension frame 80 provided at the upper end part of the support post 70, positioned outside the work cage 110, and allowing a worker to work above the upper end of the support post 70. Further, the work vehicle 1 is configured by the upper ends of the cables 131 on both sides of the work gondola apparatus 100 being suspended on the suspension frame 80 of the work vehicle 1.

In other words, the work vehicle 1 provided with the work gondola apparatus 100 of the invention (hereinafter, simply referred to as the work vehicle) is provided with the suspension frame 80 suspending the work gondola apparatus 100 via the support post 70 at the tip part of the arm mechanism 60 mounted on the vehicle body 20 and the work cage 110 suspended via the cable 131 from the suspension frame 80 is elevated/lowered by means of the elevating/lowering mechanism 130.

As a result, the work vehicle 1 is capable of freely moving on a road or the like and is capable of moving the tip of the arm mechanism 60 of the vehicle body 20 to a desired position. In addition, by elevating/lowering the work cage 110 suspended from the suspension frame 80 at the tip of the arm mechanism 60, a worker can work at a desired position in the range of the elevating/lowering, can work above the suspension frame 80 positioned outside the work cage 110 in the work cage 110, and can perform a wide range of work without work range limitations.

The work vehicle 1 of the present embodiment is used as, for example, a bridge inspection vehicle as a vehicle for work at height. As in the bridge inspection vehicle of the related art, the arm mechanism 60 is mounted on the vehicle body 20 and the tip part of the arm can be moved to a desired position by the arm mechanism 60. The arm mechanism 60 is provided in combination with one or a plurality of sets of the turning mechanism 30A, 30B, shown in FIG. 9 as two turning mechanisms $\mathbf{30}_1$, $\mathbf{30}_2$, respectively, one or a plurality of sets of the telescopic mechanism 40A, 40B, 40C, shown in FIG. 9 as three telescopic mechanisms, $\mathbf{40}_1$, $\mathbf{40}_2$, $\mathbf{40}_3$, respectively, and one or a plurality of sets of the derricking mechanism 50A, 50B, shown in FIG. 9 as two derricking mechanisms $\mathbf{50}_1$, $\mathbf{50}_2$, respectively.

Figure 9:
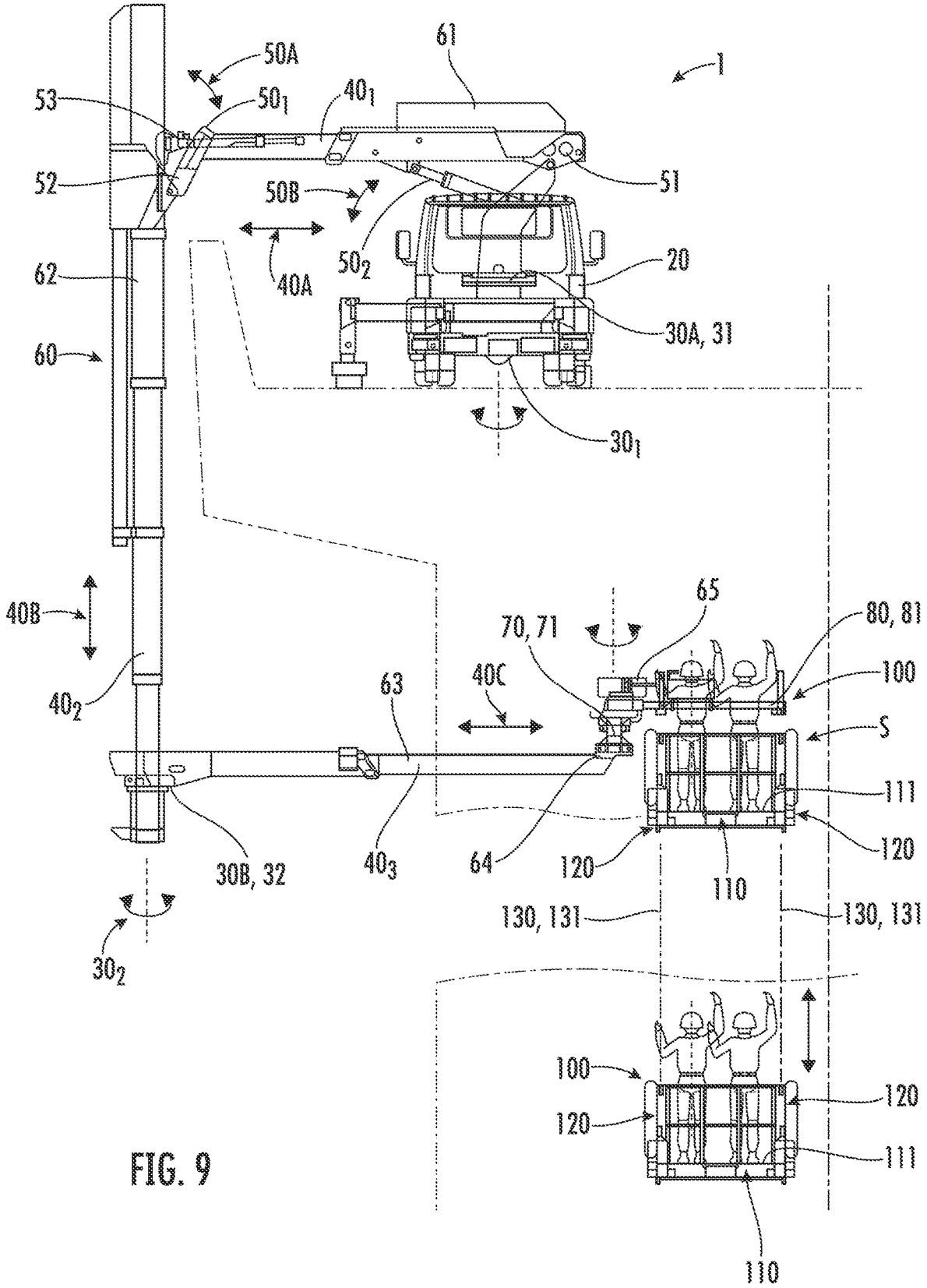
FIG. 9 is a schematic configuration diagram of a work vehicle provided with the work gondola apparatus according to the embodiment of the invention.
Figure 10A:
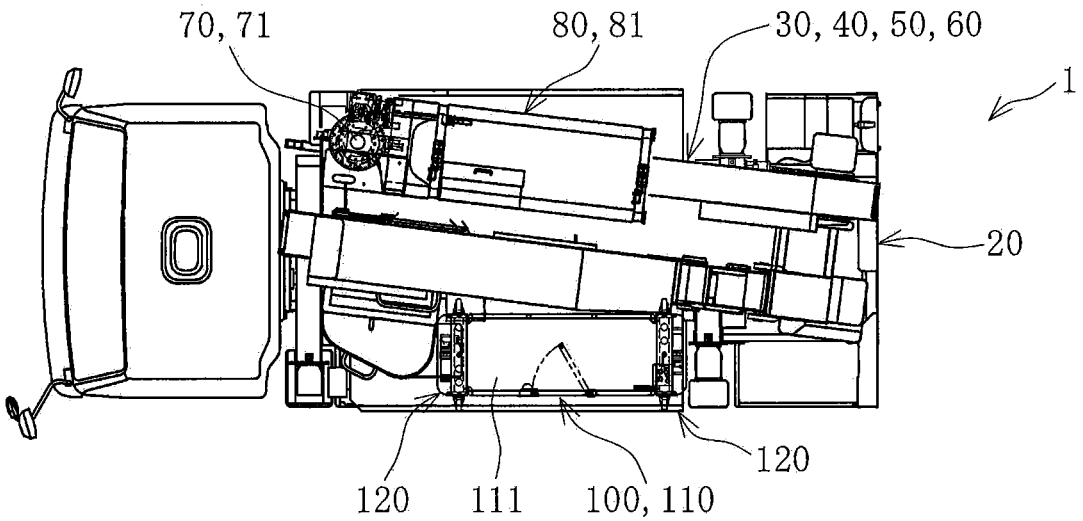
FIG. 10A is a plan view of the work vehicle according to the embodiment of the invention.
Figure 10B:
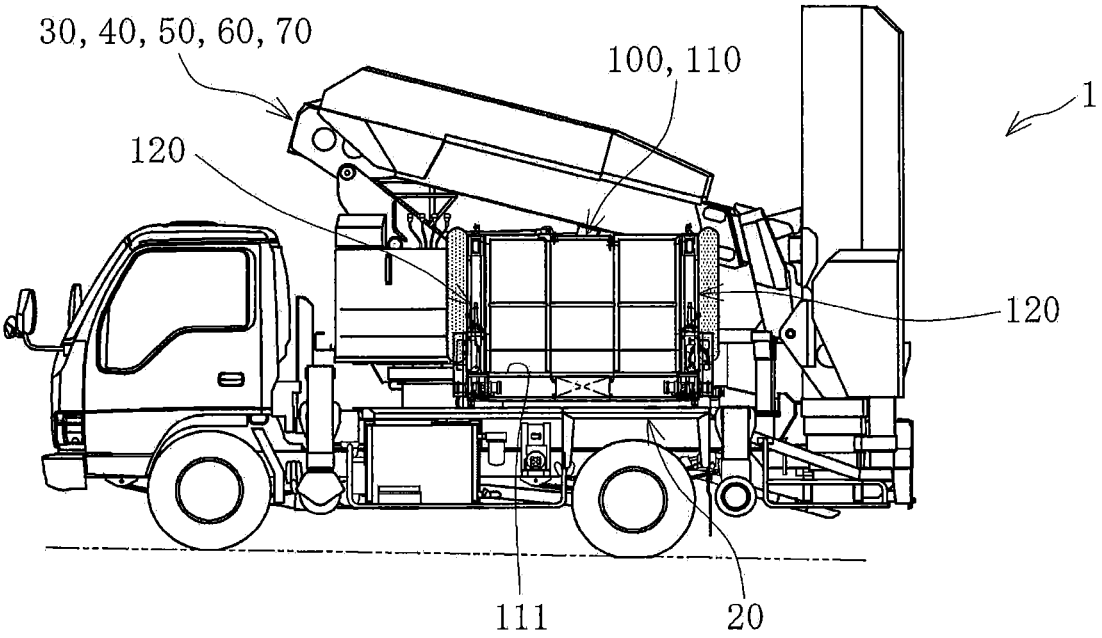
FIG. 10B is a side view of the work vehicle according to the embodiment of the invention.

As illustrated in FIG. 9, the arm mechanism 60 is constituted by, for example, three booms and is provided with a second boom 62 and a third boom 63 toward the tip part from a first boom 61 at the proximal end part.

The first boom 61 is provided with a plurality of telescopic booms and can be extended and retracted by the telescopic mechanism $\mathbf{40}_1$. The first boom 61 is attached via a horizontal derricking shaft 51 of the derricking mechanism 50 to a turning base 31 as the turning mechanism $\mathbf{30}_1$ turning around a vertical axis and provided on the vehicle body 20 and is capable of turning and derricking.

The second boom 62 is provided with a plurality of telescopic booms and can be extended and retracted by the telescopic mechanism $\mathbf{40}_2$. The second boom 62 is attached to a turning base 32 turning the third boom 63 via a leveling arm 52 constituting the derricking mechanism $\mathbf{50}_1$ provided at the tip part of the first boom 61.

The third boom 63 is provided with a plurality of telescopic booms and can be extended and retracted by the telescopic mechanism $\mathbf{40}_3$. The third boom 63 is attached to the second boom 62 via the turning base 32 constituting the turning mechanism $\mathbf{30}_2$ provided at the tip part of the second boom 62.

A work cage mount 64 capable of maintaining a horizontal state is provided at the tip part of the third boom 63.

The arm mechanism 60 moving the tip part of the third boom 63 to a desired position is configured by the turning mechanism $\mathbf{30}_2$, the telescopic mechanism $\mathbf{40}_3$, and the derricking mechanism $\mathbf{50}_1$ being combined with the first boom 61 to the third boom 63.

The turning mechanism 30, the telescopic mechanism 40, and the derricking mechanism 50 of the arm mechanism 60 are provided with an electric drive device and a hydraulic drive device such as a hydraulic cylinder and a hydraulic motor and are driven by the devices. The arm mechanism 60 can be operated from an upper limit stop position S (described later) of the work cage 110 via an arm operation panel 65 of the arm mechanism 60.

In the work vehicle 1, an AC electric power source of 100 V to 220 V is ensured by a generator mounted on the vehicle body 20 as well as a hydraulic drive mechanism and electric power can be supplied to the arm operation panel 65.

The configuration of the arm mechanism 60 is merely an example applied to a bridge inspection vehicle and is not limited to this embodiment. The number of booms and the disposition of, for example, each of the mechanisms 30, 40, and 50 connecting the booms may be appropriately determined insofar as the tip part of the arm mechanism 60 can be moved to a desired position.

The work gondola apparatus 100 is attached to the work cage mount 64 at the tip part of the arm mechanism 60, the tip part of the third boom 63 in the present embodiment.

The vertically extending support post 70 is installed on the work cage mount 64. In the present embodiment, the support post 70 is provided on the work cage mount 64 as a turning post 71 pivoting around a vertical axis.

The work cage mount 64 to which the support post 70 is attached may be turned around a vertical axis on the arm mechanism 60 side. Then, even the fixed support post 70 is capable of functioning similarly to the turning post 71.

Even in a case where the work cage mount 64 is turned and even in a case where the work cage mount 64 is turned from the arm mechanism 60 side, the turning operation may be enabled by the operation panel 160 of the work cage 110 described above being operated.

In a configuration as an exemplary drive mechanism for turning the turning post 71, a worm wheel is attached to the work cage mount 64 and to the turning post 71 and a worm meshing with the worm wheel can be turned by means of a manual handle or can be driven by means of a hydraulic motor or an electric motor.

The suspension frame 80 is constituted by a frame 81 (see FIGS. 10A and 10B) provided at the upper end of the turning post 71, formed in a horizontally long rectangular shape on a horizontal plane, larger than the work cage 110, and having a size capable of surrounding the outside of the work cage 110. The middle portion of one short side of the suspension frame 80 is attached to the turning post 71 and the turning post 71 laterally protrudes.

The suspension frame 80 can be a frame (not illustrated) formed in a concave and substantially rectangular shape, larger than the work cage 110, and having a size capable of surrounding the outside of the work cage. In addition, the frame is not limited to a case where the frame is disposed on a horizontal plane and the frame may have a substantially concave vertical cross-sectional shape open downward and be combined with a substantially concave or rectangular formation on a horizontal plane. The planar shape of the suspension frame 80 is not limited to a rectangular shape and may be another shape insofar as the size and the shape allow work above the suspension frame 80 from the inside of the work cage 110, exceed the work cage 110, and allow the outside of the cage to be surrounded.

With the frame-shaped suspension frame 80, it is possible to work upward from the inside of the frame 81 larger than the work cage 110 and having a size capable of surrounding the outside unlike in the case of a single beam.

Fixed to and suspended from the frame 81 of the suspension frame 80 is the upper end part of the cable 131 constituted by a plurality of cables 131 (such as two wire ropes) constituting the elevating/lowering mechanism 130 elevating/lowering the work cage 110.

A twisting mechanism (not illustrated) of the cable 131 is provided between the suspension frame 80 and the cable 131. As a result, the cable 131 is pivotable around a central axis and no twisting occurs.

As illustrated in FIGS. 1 to 3, 5, and 6, the lower ends of the two suspended cables 131 are wound around the sheaves of the endless winders 132 installed at the equipment mounting parts 120. In, for example, the two endless winders 132 constituting the elevating/lowering mechanism 130 mounted at the equipment mounting part 120, the two cables (wire ropes) 131 fixed to and suspended from the suspension frame 80 are respectively wound around the sheaves on the right and left. As described above, the work cage 110 is elevated/lowered while the winding position of the cable 131 is moved by the frictional force between the cable 131 and the sheave of the endless winder 132.

If necessary, a sheet or a net for curing is attached to the work cage 110 and the equipment mounting part 120 so that a work-related falling or scattering object is prevented.

In a case where the work cage 110 is positioned at the upper limit stop position S in the work vehicle 1, charging can be performed by electric power being supplied from the outside to the battery 140 and the auxiliary battery 141 mounted at the equipment mounting part 120 via a charging connector (not illustrated) provided on the operation panel 160.

In addition, a regenerative current can be recovered to the battery 140 from the motors 133 and 134 for driving the endless winder 132 and energy can be saved as a result.

During traveling with the work gondola apparatus 100 mounted on the vehicle body 20, electric power supply can be performed from an electric power generation device of the vehicle via a charging connector (not illustrated) provided on the vehicle body 20. The two batteries 140 and the auxiliary battery 141 can be charged as a result.

Two or three or more spare batteries 140 may be provided in the work vehicle 1 in addition to the auxiliary battery 141 and the two batteries 140 mounted at the equipment mounting part 120. Gondola work can be continuously performed by the spare batteries being charged during work in the work gondola apparatus 100.

In the work vehicle 1, the endless winder 132 is used so that the length of the cable 131 suspended from the suspension frame 80 is a length in accordance with the elevation range of the work cage 110. As a result, work on a wall surface can be performed with the work cage 110 elevated/lowered within a desired range and without any limitation.

During work from the work cage 110, it is possible to adjust the position of the suspension frame 80 around the vertical axis such that the work cage 110 becomes parallel to the work wall surface by turning of the turning post 71.

The work vehicle 1 provided with the work gondola apparatus 100 is provided with an interlock mechanism for safe work and is mechanically and electrically interlocked.

The arm mechanism 60 cannot be operated during work with the work gondola apparatus 100. In other words, the arm operation panel 65 of the arm mechanism 60 is installed on the support post 70 at the tip part of the arm mechanism 60, the turning post 71 in the present embodiment, and is disposed so as to be reached by a worker's hand only in a case where the work cage 110 suspended from the suspension frame 80 is positioned at the upper limit stop position S. As a result, after the work cage 110 begins to be elevated/lowered (lowered), the arm operation panel 65 is physically disposed so as not to be reached by the worker's hand and the operation of the arm mechanism 60 is disabled.

A connection holding mechanism (not illustrated) is provided between the work cage 110 and the suspension frame 80 as a mechanical lock mechanism. The connection holding mechanism fixes the work cage 110 at the upper limit stop position S to the suspension frame 80 such that elevating/lowering (lowering) is impossible. The connection holding mechanism connects the work cage 110 to the suspension frame 80 and holds the work cage 110 by hooking the hook at the lower enol part of a connecting rod having an upper end part fixed to the suspension frame 80 to the hole of the bracket of the work cage 110. The connection holding of the work cage 110 based on the connecting holding mechanism can be easily performed by, for example, lowering the work cage 110 to the upper limit stop position S after the hook is hooked on the bracket of the work cage 110 with the work cage 110 slightly elevated from the upper limit stop position S. In contrast, releasing of the connection holding state can be performed by slight elevation and connection holding mechanism removal.

With the connection holding mechanism, the work cage 110 can be connected to and held by the suspension frame 80, elevating/lowering (lowering) of the work cage 110 can be disabled, and load application to the two cables 131 can be prevented.

Further, the cable 131 that suspends the work cage 110 is provided with a load detection unit (not illustrated). The load detection unit electrically detects the upper limit stop position S where no load is applied to the cable 131. In other words, for detection of the work cage 110 being connected and fixed to the suspension frame 80 by the connection holding mechanism, a load cell is provided on the suspension frame 80 as the load detection unit and the cable 131 is suspended. The load cell electrically detects a load exceeding a set value.

In addition, a striker is attached to the work cage 110, a mechanical limit switch is provided on the suspension frame 80 side, and the upper limit stop position S of the work cage 110 is obtained as an electrical signal by the limit switch. Further, the upper limit stop position S of the work cage 110 is obtained as an electrical signal by a proximity sensor, a load cell, or a limit switch detecting the position of the work cage 110.

With the load detection unit, the upper limit stop position S where no load is applied to the cable 131 can be electrically detected and an operation such as the elevating/lowering of the work cage 110 can be interlocked.

As a result, an interlock state where the arm mechanism 60 cannot be operated can be initiated when the work cage 110 is not at the upper limit stop position S.

A worker works as follows in the work vehicle 1 provided with the work gondola apparatus 100 configured as described above.

The worker moves to a work site by traveling of the work vehicle 1 on a road.

At the work site, the worker prepares for work initiation on the vehicle body 20 side in the case of using as a normal bridge inspection vehicle or a vehicle for work at height. In other words, pre-work initiation inspection, confirmation of a flat road surface, stop state confirmation for a parking brake and the like, outrigger operation, and the like are performed.

Next, the worker enters the work cage 110 suspended at the upper limit stop position S at the tip part of the arm mechanism 60 and connected and held by the connection holding mechanism.

Subsequently, the worker operates the arm operation panel 65 attached to the turning post 71 from the inside of the work cage 110 and disposes the work cage 110 at a desired position (work start point) of a work object by means of each of the mechanisms 30, 40, and 50 of the arm mechanism 60.

Safety is ensured by an operation being performed at the arm operation panel 65 in the case of a state where the work cage 110 is mechanically connected and held by the connection holding mechanism at the upper limit stop position S and the interlock state where a load electrically applied to the cable 131 is not applied or the upper limit stop position S is electrically detected by the load detection unit.

Further, the turning post 71 is turned and the work cage 110 is disposed parallel to the wall surface by an operation from the operation panel 160 of the work cage 110. The preparation is completed as a result.

In a case where the work based on the work cage 110 is initiated, the mechanical connection holding by the connection holding mechanism is released. The work cage 110 is slightly elevated and the hook of the connection holding mechanism is removed from the bracket of the work cage 110.

Once the connection holding state is released, the load detection unit detects that a load is applied to the cable 131 or, for example, the work cage 110 is not at the upper limit stop position S (for example, the work cage 110 is slightly lowered). Then, the operation on the arm operation panel 65 is interlocked and the operation of the arm mechanism 60 is disabled. Prevented as a result is an arbitrary operation such as the arm mechanism 60 moving the position of the suspension frame 80 of the work cage 110.

Work above the suspension frame 80 from the inside of the work cage 110 is also possible during the work from the work cage 110, and thus the upper limit stop position S by the arm mechanism 60 can be adjusted in advance.

The worker performs work downward from the upper limit stop position S by elevating/lowering the work cage 110 by operating the auxiliary operation panel 162 and the operation panel 160 of the equipment mounting part 120 from the work cage 110. In addition, in a case where the work surface is curved or the like, the worker changes the direction of the work cage 110 by turning the turning post 71 by operating the operation panel 160 of the work cage 110, and then work is performed with the work cage 110 disposed parallel to the wall surface.

After the elevating/lowering-based work is performed with the tip part of the arm mechanism 60 disposed at a desired position in this manner, the work in the elevation range at one place is completed by the work cage 110 being elevated and returned to the upper limit stop position S.

Subsequently, the work cage 110 is connected and held at the upper limit stop position S. Then, the worker operates the arm operation panel 65 from the inside of the work cage 110 and repeatedly moves the position of the tip part of the arm mechanism 60 to the next working location. Then, the worker similarly operates the arm operation panel 65 to work by elevating/lowering the work cage 110.

In addition, with the work cage 110 returned to the upper limit stop position S, the battery 140 and the auxiliary battery 141 mounted on the work cage 110 are charged if necessary.

In a case where the work cage 110 tilts or the elevating/lowering speed by one of the endless winders 132 is reduced during the work in the work cage 110, which indicates that the battery 140 is exhausted, the worker switches the changeover switch 161 of the operation panel 160 to preliminary.

Then, electric power is supplied from the auxiliary battery 141 to the left and right motors 133 and 134 of the endless winders 132. Although the speed of the work cage 110 is reduced, the work cage 110 can be returned to the upper limit stop position S. Upon returning to the upper limit stop position S, the worker replaces the battery 140 with a spare battery or charges the battery and prepares for the next work.

After the work on all wall surfaces is completed by the combination of the elevating/lowering and the repetition of the movement of the work start point by the arm mechanism 60 during the work in the work vehicle 1, an operation for returning the arm mechanism 60 to the initial state is performed. Then, the arm mechanism 60 is returned such that the work vehicle 1 is capable of traveling.

The work is completed as a result.

In the work vehicle 1, the battery-driven work gondola apparatus 100 is suspended via the support post 70 and the suspension frame 80 on the arm mechanism 60 mounted on the vehicle body 20 and work is performed by the suspended work gondola apparatus 100 being elevated/lowered. Accordingly, there is no work site constraint for ensuring an electric power source for driving or the like, the vehicle can be moved by traveling, and work can be performed in a stable state without, for example, tilting of the work cage 110.

The turning post 71 turning around a vertical axis constitutes the support post 70, and thus the direction of the suspension frame 80 can be changed and the work cage 110 can be disposed along the work surface. Accordingly, a worker can work while maintaining a reasonable posture.

The battery 140 and the auxiliary battery 141 can be charged during traveling for a movement to a work site with a charging device (not illustrated) mounted on the work vehicle 1, and thus the charging can be completed before work initiation and gondola work can be performed with efficiency.

The work vehicle 1 has the same action and effect as the work gondola apparatus 100 described above and allows a wide range of work with the vehicle-mounted work gondola apparatus 100 as compared with the vehicle for work at height such as the bridge inspection vehicle of the related art. Accordingly, a worker can safely and efficiently perform, for example, inspection and repair of the entire surface of a bridge pier part of a road bridge or the like.

Although the work vehicle 1 performing only elevating/lowering with the work cage 110 suspended from the suspension frame 80 has been described in the above embodiment, a traverse mechanism may be provided between the suspension frame 80 and the work cage 110 of the work vehicle 1 such that a cable support part is configured to be laterally movable by means of a trolley or the like. The work range can be further expanded in that case.

In addition, the invention is not limited to the above embodiment and each component can be changed without departing from the scope of the invention.

As described in detail with reference to the above embodiment, the work gondola apparatus 100 of the invention is provided with the work cage 110 into which a worker boards, the equipment mounting parts 120 disposed on both outer sides of the work cage 110, the battery-driven elevating/lowering mechanisms 130 which are mounted to the respective equipment mounting parts 120 and which elevate/lower the work cage 110 to a working location by means of the cables 131 that are being suspended, and the batteries 140 for driving the respective elevating/lowering mechanisms 130. The equipment mounting parts 120 are configured so as to substantially keep the weight balance between the right and left sides. Since the battery-driven elevating/lowering mechanism 130 and the battery 140 are mounted on the equipment mounting parts 120 provided on both sides of the work cage 110 in this configuration, the weight balance between the right and left sides can be substantially kept, uneven tension in the right and left cables 131 can be prevented, and the work cage can be elevated/lowered in a stable state. In addition, since the elevating/lowering mechanism 130 is battery-driven, a power source can be ensured with ease and it is possible to work by elevating/lowering the work cage 110 regardless of work sites. Since the elevating/lowering mechanism 130 is mounted on the equipment mounting part 120, there is no load in the work cage 110 and a worker can freely move and work in the work cage 110. By connecting the equipment mounting part 120 on both sides, the work gondola apparatus 100 can be configured even when the size of the work cage 110 is changed. As a result, the work cage 110 of any size and the equipment mounting parts 120 on both sides can be a unit and the work gondola apparatus 100 can be obtained with the work cage 110 and the equipment mounting parts 120 combined.

In the work gondola apparatus 100 of the invention, the battery 140 is provided with the auxiliary battery 141 and the auxiliary battery 141 is configured to be capable of simultaneously driving the elevating/lowering mechanisms 130 on both sides. Accordingly, the elevating/lowering mechanisms 130 on both sides can be driven by switching to the auxiliary battery 141 and, even when the battery 140 is exhausted, the weight balance between the right and left sides of the work cage 110 can be kept, elevating/lowering can be performed with safety, and returning to the original position or the like can be performed.

In the work gondola apparatus 100 of the invention, the battery 140 and the auxiliary battery 141 are mounted so as to be detachable from the work cage 110 side, and thus the battery 140 and the auxiliary battery 141 mounted on the equipment mounting parts 120 on both sides can be easily replaced from the inside of the work cage 110 and work can be performed with efficient replacement performed.

In the work gondola apparatus 100 of the invention, the elevating/lowering mechanism 130 is configured to be provided with the endless winder 132 performing elevating/lowering by changing the position of the cable 131 by rotation of the sheave around which the cable 131 is wound and the winding reel 135 winding or unwinding the cable 131 by rotation below the sheave. Accordingly, even when the lift required for work has changed, the change can be easily responded to by replacement of the cable 131 with a cable corresponding to the required lift and the elevating/lowering mechanism 130 can be simplified. Since the cable 131 is accommodated in the rotary winding reel 135, there is no need to drive the winding reel 135 for winding or unwinding and weight reduction can be achieved by combination with the battery-driven endless winder 132.

The work gondola apparatus 100 of the invention is provided with the area sensor 170 detecting an obstacle in the downward direction and the elevating/lowering mechanism 130 is stopped by a detection signal from the area sensor 170. Accordingly, as compared with existing contact sensors, the area sensor 170 is capable of detecting an obstacle in a non-contact state and is capable of detecting an obstacle even on a sea surface and the like and in planting. Accordingly, safe work is possible with contact with an obstacle or the like prevented.

In the work gondola apparatus 100 of the invention, the lower end part of the cable 131 is colored and the work gondola apparatus 100 is provided with the color recognition sensor 171 detecting the colored part of the cable 131. A worker can visually recognize the elevating/lowering limit by means of the coloring of the cable 131 and can stop the elevating/lowering by the elevating/lowering mechanism 130 by using the color recognition sensor 171. Accordingly, the cable 131 can be prevented from falling from the elevating/lowering mechanism 130 and safe work is possible in the range of the effective length of the cable 131.

The work gondola apparatus 100 of the invention is configured such that the frames (posts) 112 on both sides of the work cage 110 and the frame (main frame part) 121 inside the equipment mounting part 120 are used in common. Accordingly, the structures of the work cage 110 and the equipment mounting part 120 can be simplified and a constituent material can be used in accordance with the required strength. In particular, the material of the work cage 110 can be aluminized or resinified and the work cage 110 can be reduced in weight.

The work vehicle 1 provided with the work gondola apparatus 100 of the invention is provided with the work gondola apparatus 100, the arm mechanism 60 moving the tip part to a desired position by combining the turning mechanism 30, the telescopic mechanism 40, and the derricking mechanism 50 mounted on the vehicle body 20, the vertically extending support post 70 provided at the tip part of the arm mechanism 60, and the suspension frame 80 provided at the upper end part of the support post 70, positioned outside the work cage 110, and allowing a worker to work above the upper end of the support post 70. Since the upper ends of the cables 131 on both sides of the work gondola apparatus 100 are suspended from the suspension frame 80 of the work vehicle 1, the battery-driven work gondola apparatus 100 is capable of traveling and moving on a general public road. In addition, the work cage 110 can be installed at a desired position with the weight balance between the right and left sides ensured by the arm mechanism 60 from the top of a road and a wide range of work can be safely performed by means of the elevated/lowered work cage 110. In addition, by the work cage 110 being suspended via the suspension frame 80, work above the work cage 110, which cannot be performed by the gondola of the related art, can be performed. This mechanism is applied to a vehicle for work at height or the like.

As a result, the work cage 110 of the battery-driven work gondola apparatus 100 can be moved to any position, and thus a wide range of work can be performed without power supply problems and work site constraints.

With the work vehicle 1, a movement to a work site and work preparation and withdrawal at the work site can be expedited and work efficiency is significantly improved as compared with a case where work is performed based on suspension from a rooftop or the like.

In the work vehicle 1 provided with the work gondola apparatus 100 of the invention, the turning post 71 turning around a vertical axis constitutes the support post 70, and thus the direction of the suspension frame 80 around the vertical axis can be changed by the turning of the turning post 71 and work on the work surface and the like can be efficiently performed with the direction of the work cage 110 adjusted.

The work vehicle 1 provided with the work gondola apparatus 100 of the invention is configured to be equipped with a charging device charging the battery 140 and the auxiliary battery 141 during traveling, and thus the battery 140 and the auxiliary battery 141 can be charged during traveling for a movement to a work site. Accordingly, the charging can be completed before work initiation and gondola work can be performed with efficiency.

The invention allows various embodiments and modifications without departing from the broad spirit and scope of the invention. In addition, the embodiment described above is for describing the invention and does not limit the scope of the invention. In other words, the scope of the invention is indicated not by the embodiment but by the claims. Various modifications made within the scope of the claims and the meaning of the invention equivalent to the claims are considered to be within the scope of the invention.

In the work gondola apparatus as mentioned in the above back ground section, in a case where the inspection and repair of the structure such as the bridge are performed by means of the vehicle for work at height and the height of the bridge pier is tens of meters, there is a place inaccessible from the top of the road even by arm mechanism extension and retraction and the range of the work is limited.

With the work gondola apparatus, a wide range of downward work can be performed by the cable suspending the work cage being lengthened. However, the region above the suspension point of the cable or the lower surface of a road slab and the region below the lower surface cannot be accessed and worked on as the work cage cannot be suspended from the top of the road.

In addition, although work range constraints can be alleviated by the endless winder being mounted in the work cage in the work gondola apparatus, power needs to be supplied for the endless winder to be driven and an electric power supply cable capable of corresponding to the work range is required.

In this regard, it is conceivable to use a battery-driven endless winder requiring no electric power supply cable. However, once a battery or the like is mounted on a work cage suspended by means of two cables, for example, uneven loads may be applied to the right and left cables and it may be impossible for the work cage to be elevated/lowered with level maintained. In addition, the battery and the like mounted on the work cage may hinder a worker's movement in the work cage or lead to workability deterioration.

The above-explained embodiments of the present invention has been made in view of the problems of the related art described above, and an object of the embodiments is to provide a work gondola apparatus allowing work to be performed in a stable state without work site constraints and a work vehicle provided with the work gondola apparatus.

In order to achieve the above object, one aspect of the present invention provides a work gondola apparatus, comprises: a work cage into which a worker boards; equipment mounting parts disposed on both outer sides of the work cage; battery-driven elevating/lowering mechanisms which are mounted to the respective equipment mounting parts and which elevate/lower the work cage to a working location by means of cables that are being suspended; and batteries for driving the respective elevating/lowering mechanisms, wherein the battery is provided with an auxiliary battery and the auxiliary battery is configured to be capable of simultaneously driving the elevating/lowering mechanisms on both sides, and the equipment mounting parts are configured so as to substantially keep the weight balance between the right and left sides.

It is preferable that the auxiliary battery is mounted so as to be detachable from an inside of the work cage.

Another aspect of the present invention provides a work gondola apparatus, comprises: a work cage into which a worker boards; equipment mounting parts disposed on both outer sides of the work cage; battery-driven elevating/lowering mechanisms which are mounted to the respective equipment mounting parts and which elevate/lower the work cage to a working location by means of cables that are being suspended; and batteries for driving the respective elevating/lowering mechanisms, wherein the battery is mounted so as to be detachable from an inside of the work cage, and the equipment mounting parts are configured so as to substantially keep the weight balance between the right and left sides.

Another aspect of the present invention provides a work gondola apparatus, comprises: a work cage into which a worker boards; equipment mounting parts disposed on both outer sides of the work cage; battery-driven elevating/lowering mechanisms which are mounted to the respective equipment mounting parts and which elevate/lower the work cage to a working location by means of cables that are being suspended; batteries for driving the respective elevating/lowering mechanisms; and a color recognition sensor detecting a colored lower end part of the cable, wherein the equipment mounting parts are configured so as to substantially keep the weight balance between the right and left sides, and the elevating/lowering mechanism is stopped by a detection signal from the color recognition sensor.

Another aspect of the present invention provides a work gondola apparatus, comprises: a work cage into which a worker boards; equipment mounting parts disposed on both outer sides of the work cage; battery-driven elevating/lowering mechanisms which are mounted to the respective equipment mounting parts and which elevate/lower the work cage to a working location by means of cables that are being suspended; and batteries for driving the respective elevating/lowering mechanisms, wherein the equipment mounting parts are configured so as to substantially keep the weight balance between the right and left sides, and frames on both sides of the work cage and frames inside the equipment mounting parts are configured to be used in common.

It is preferable that the work gondola apparatus comprises a color recognition sensor detecting a colored lower end part of the cable, wherein the elevating/lowering mechanism is stopped by a detection signal from the color recognition sensor.

It is preferable in the work gondola apparatus that frames on both sides of the work cage and frames inside the equipment mounting parts are configured to be used in common.

It is preferable that the elevating/lowering mechanism is configured to be provided with an endless winder performing elevating/lowering by changing a position of the cable by rotation of a sheave around which the cable is wound and a winding reel winding or unwinding the cable by rotation below the sheave.

It is preferable that the work gondola apparatus further comprises an area sensor detecting an obstacle in a downward direction, wherein the elevating/lowering mechanism is stopped by a detection signal from the area sensor.

Another aspect of the present invention provides a work gondola apparatus, comprises: the work gondola apparatus according to any one of the first to the fourth aspect of the present invention; an arm mechanism moving a tip part to a desired position by combining a turning mechanism, a telescopic mechanism, and a derricking mechanism mounted on a vehicle body; a vertically extending support post provided at a tip part of the arm mechanism; and a suspension frame provided at an upper end part of the support post, positioned outside the work cage, and allowing the worker to work above an upper end of the support post, wherein the work vehicle is configured by upper ends of the cables on both sides of the work gondola apparatus being suspended on the suspension frame of the work vehicle.

It is preferable that a turning post turning around a vertical axis constitutes the support post.

It is preferable that the work vehicle is configured by a charging device being mounted and the charging device charges the battery and the auxiliary battery during traveling of the work vehicle.

According to the above aspects of the present inventions, there is no work site constraints and work can be done in a stable state.

Reference Signs List

100 Work gondola apparatus
110 Work cage
111 Work floor
112 Post
113 Intermediate post
114 Horizontal member
115 Front frame
116 Rear frame
117 Opening/closing frame
118 Bottom frame
120 Equipment mounting part
121 Main frame part
122 Protective frame part
123 Bottom frame part
124 Buffer
125 Pressure roller
126 Rubber leg
130 Elevating/lowering mechanism
131 Cable
132 Endless winder
133 Left motor
134 Right motor
135 Winding reel
136 Gripping device
137 Retaining device
140 Battery
141 Auxiliary battery
142 Battery box
150 Control panel
151 Main circuit
152 Control circuit
160 Operation panel
161 Changeover switch
162 Auxiliary operation panel
163 Emergency stop button
170 Area sensor

171 Color recognition sensor
1 Work vehicle (work vehicle provided with gondola apparatus)
20 Vehicle body
30 Turning mechanism
31 Turning base
32 Turning base
40 Telescopic mechanism
50 Derricking mechanism
51 Derricking shaft
52 Leveling arm
53 Derricking shaft
60 Arm mechanism
61 First boom
62 Second boom
63 Third boom
64 Work cage mount
65 Arm operation panel
70 Support post
71 Turning post
80 Suspension frame
81 Frame
S Upper limit stop position

What is claimed is:

1. A work gondola apparatus comprising:

a work cage configured to allow a worker to board into said work cage, the work cage having a work surface configured to face an exterior surface of a target structure;

equipment mounting parts disposed on the work cage;

elevating and lowering mechanisms mounted onto the equipment mounting parts, said elevating and lowering mechanisms are configured to respectively elevate and lower the work cage to a working location by suspended cables;

batteries configured to drive the elevating and lowering mechanisms; and a color recognition sensor configured to detect a colored lower end part of one or more of the cables, wherein the equipment mounting parts are configured so as to substantially keep a weight balance in at least one dimension, and wherein the elevating and lowering mechanisms are configured to stop in response to a detection signal from the color recognition sensor.

2. The work gondola apparatus according to claim 1, wherein the work cage has a front frame, a rear frame and opposing right and left side frames coupled to the front frame and rear frame, and wherein the right and left side frames of the work cage cooperate with frames of the equipment mounting parts.

3. The work gondola apparatus according to claim 1, wherein the elevating and lowering mechanisms each comprise an endless winder configured to change a position of one or more of the cables by rotation of a sheave around which a respective cable is wound and a winding reel that is configured to wind and unwind the respective cable by rotation below the sheave.

4. The work gondola apparatus according to claim 1, further comprising an area sensor detecting an obstacle in a downward direction, wherein the elevating and lowering mechanisms are configured to stop in response to the detection signal from the area sensor.

5. The work gondola apparatus according to claim 1 in combination with a work vehicle, the work vehicle further comprising:

an arm mechanism configured to move a tip part to a desired position by combining a turning mechanism, a telescopic mechanism, and a derricking mechanism mounted on a vehicle body;

a vertically extending support post provided at the tip part of the arm mechanism; and a suspension frame provided at an upper end part of the support post, positioned outside the work cage, and configured to allow the worker to work above an upper end of the support post, wherein the work vehicle is configured by upper ends of the cables on at least two sides of the work gondola apparatus being suspended on the suspension frame of the work vehicle.

6. A work gondola apparatus comprising:

a work cage configured for a worker to board into said work cage;

equipment mounting parts disposed on the work cage;

elevating and lowering mechanisms mounted to the equipment mounting parts, said elevating and lowering mechanisms are configured to respectively elevate and lower the work cage using one or more suspended cables;

at least one battery configured to power each of the elevating and lowering mechanisms; and a color recognition sensor configured for detecting a colored lower end part of one or more of the cables, wherein the at least one battery is provided with an auxiliary battery and the auxiliary battery is configured to simultaneously drive the elevating and lowering mechanisms or the at least one battery is mounted so as to be detachable from an inside of the work cage, wherein the equipment mounting parts are configured so as to substantially keep a weight balance in at least one dimension of the work cage, and wherein the elevating and lowering mechanisms are configured to stop in response to a detection signal from the color recognition sensor.

7. A work gondola apparatus comprising:

a work cage configured for a worker to board into said work cage;

equipment mounting parts disposed on the work cage;

elevating and lowering mechanisms mounted onto the equipment mounting parts, said elevating and lowering mechanisms are configured to respectively elevate and lower the work cage to a target working location using suspended cables;

at least one battery for driving the respective elevating and lowering mechanisms; and a color recognition sensor configured to detect a colored lower end part of one or more of the cables, wherein the equipment mounting parts are configured so as to substantially keep a weight balance in at least one dimension, and wherein the elevating and lowering mechanisms are configured to stop in response to a detection signal from the color recognition sensor.

8. The work gondola apparatus according to claim 7, wherein the elevating and lowering mechanisms each comprise an endless winder configured to change a position of a respective cable of the cables by rotation of a sheave around which the respective cable is wound and a winding reel that is configured to wind and unwind the cable by rotation below the sheave.

9. The work gondola apparatus according to claim 7, further comprising an area sensor configured to detect an obstacle in a downward direction, wherein the elevating and lowering mechanism are configured to stop in response to the detection signal from the area sensor.

10. The work gondola apparatus according claim 7 in combination with a work vehicle, the work vehicle further comprising:

an arm mechanism configured to move a tip part to a desired position by combining a turning mechanism, a telescopic mechanism, and a derricking mechanism mounted on a vehicle body;

a vertically extending support post provided at a tip part of the arm mechanism; and a suspension frame provided at an upper end part of the support post, positioned outside the work cage, and configured to allow the worker to work above an upper end of the support post, wherein the work vehicle is configured by upper ends of the cables on at least two sides of the work gondola apparatus being suspended on the suspension frame of the work vehicle.

* * * * *